US005978644A

United States Patent [19]

Sato et al.

[11] Patent Number: 5,978,644

[45] Date of Patent: Nov. 2, 1999

[54] IMAGE FORMING APPARATUS

[75] Inventors: Yotaro Sato; Kunio Shigeta; Hisayoshi Nagase; Satoshi Haneda, all of Hachioji; Toshihide Miura, Koganei, all of Japan

[73] Assignee: Konica Corporation, Tokyo, Japan

[21] Appl. No.: 09/123,210

[22] Filed: Jul. 27, 1998

[30] Foreign Application Priority Data

| | | | |
|---|---|---|---|
| Aug. 5, 1997 | [JP] | Japan | 9-210568 |
| Aug. 21, 1997 | [JP] | Japan | 9-224864 |
| Sep. 8, 1997 | [JP] | Japan | 9-242657 |

[51] Int. Cl.[6] ..... G03G 21/00

[52] U.S. Cl. ..... 399/397; 399/302; 399/303; 399/309

[58] Field of Search ..... 399/397, 303, 399/308, 309, 302

[56] References Cited

U.S. PATENT DOCUMENTS

| | | | |
|---|---|---|---|
| 5,758,204 | 5/1998 | Haneda et al. | 399/66 |
| 5,761,573 | 6/1998 | Haneda et al. | 399/66 |
| 5,771,434 | 6/1998 | Hokari | 399/400 |
| 5,822,666 | 10/1998 | Haneda et al. | 399/309 |

FOREIGN PATENT DOCUMENTS

| | | |
|---|---|---|
| 49-37538 | 10/1974 | Japan . |
| 54-28740 | 9/1979 | Japan . |
| 64-44457 | 2/1989 | Japan . |
| 4-214576 | 8/1992 | Japan . |

*Primary Examiner*—Richard Moses

*Attorney, Agent, or Firm*—Frishauf, Holtz, Goodman, Langer & Chick

[57] ABSTRACT

An image forming apparatus includes: a first image bearer for bearing a toner image formed by a toner image forming device; a second image bearer for bearing the toner image which is transferred from the first image bearer; a first transferring device for transferring the toner image borne on the first image bearer onto the second image bearer or a front side of a transfer material; a second transferring device for transferring the toner image borne on the second image bearer onto a back side of the transfer material; a fixing device for fixing toner images transferred on both sides of the transfer material which is conveyed on the second image bearer and separated therefrom; and a separating claw for separating the transfer material from the second image bearer. The separating claw is provided facing a curvature portion provided at an end portion of the second image bearer on a side of the fixing device, and provided on a side of the second image bearer with respect to a tangential plane of the curvature portion passing an entrance of a nip portion for nipping the transfer material of the fixing device.

30 Claims, 22 Drawing Sheets

FIG. 3 ( A )
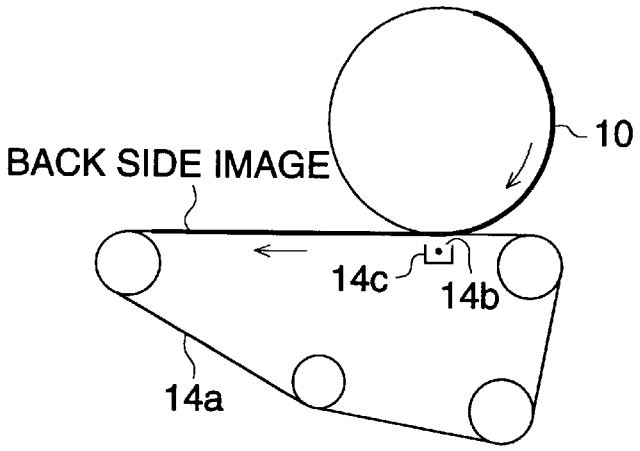
FIG. 3 ( B )
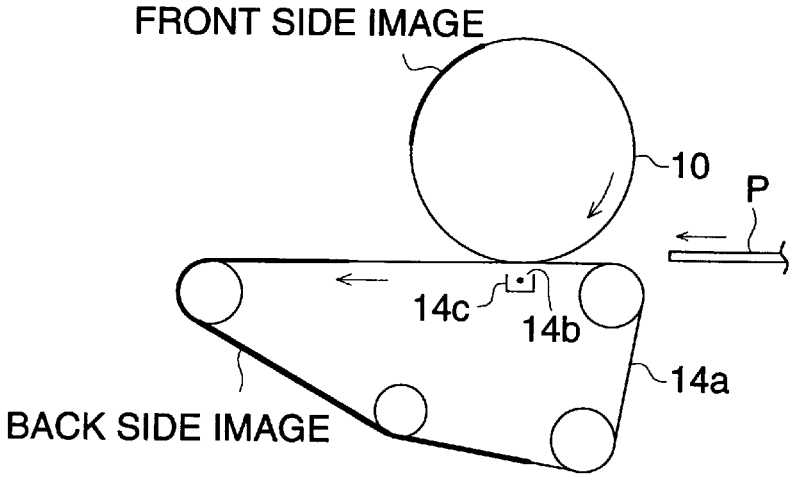
FIG. 3 ( C )
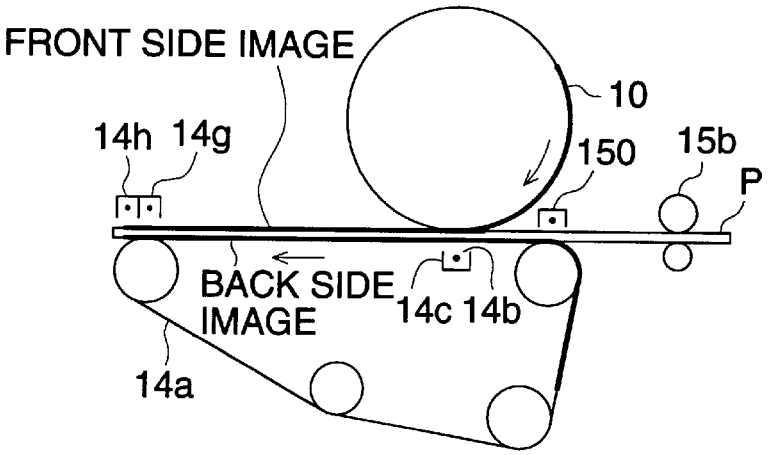

IMAGE FORMING APPARATUS

BACKGROUND OF THE INVENTION

The present invention relates to an electrophotographic type image forming apparatus such as a copier, printer, facsimile device, or the like, in which a charging means, an image writing means and developing means are arranged around an image bearing body, and a toner image formed on the image bearing body is transferred onto a transfer material and fixed, and specifically relates to an image forming apparatus by which images can be formed on both sides of the transfer material.

Conventionally, in the double-sided image formation, a method is adopted in which a one side image formed on the image bearing body is transferred onto a transfer material and fixed; the transfer material is temporarily accommodated in an intermediate feeding device; the transfer material is fed from the intermediate feeding device in timed relationship with an image formed again on the image bearing body; and the image is transferred onto the other side of the transfer material and fixed.

As described above, in this double-sided image forming apparatus, the transfer material is fed to the intermediate feeding device and the transfer material is conveyed in such a manner that it passes trough the fixing device twice, thereby, reliability of the transfer material conveyance is low, resulting in a cause of jamming or wrinkling of the transfer material.

In contrast to this, a method in which, after toner images are formed on both sides of the transfer material using a first image bearing means and a second image bearing means, fixing is carried out only once, is proposed in Japanese Patent Publication Nos. 37538/1974, 28740/1979, Japanese Patent Publication Open to Public Inspection Nos. 44457/1989, and 214576/1992.

The present inventors are investigating an image forming apparatus and image forming method in which, after toner images are formed on both sides of the transfer material using a first image bearing means and a second image bearing means, fixing is carried out only once. In this connection, when this method is applied to the color image formation, double-sided color images are formed by the following method: plural sets of toner image forming means composed of a charging means, image writing means, developing means, etc., are arranged around a photoreceptor drum (the first image bearing means); after superimposed color toner images formed on the photoreceptor drum have been collectively transferred once onto a belt-like toner image receiving body (the second image bearing means) by a first transfer means, superimposed color toner images are formed again on the photoreceptor drum; a transfer material fed in timed relationship with the toner image on the photoreceptor drum and the toner image on the toner image receiving body, is electrically charged by a transfer material charging means and is attracted to the toner image receiving body; the toner image on the photoreceptor drum is transferred onto one side of the transfer material, conveyed by the toner image receiving body, as a front side image by the first transfer means and the toner image on the toner image receiving body is transferred onto the other side of the transfer material as a reverse side image by a second transfer material; after that, the transfer material is separated from the toner image receiving body by the curvature of a roller member which is provided on a side of a fixing device (fixing means) and around which the toner image receiving body is trained, and by electrical discharging of a transfer material separating means, which is provided as needed; and the toner image on the transfer material is fixed by the fixing device and the double-sided color images are formed.

However, in the doubled-sided image forming apparatus using the belt-like toner image receiving body as described above, the transfer material just after the back side toner image has been transferred onto the transfer material by the second transfer means, is electrostatically attracted to the toner image receiving body strongly, therefore, the transfer material is very hardly separated when the transfer material is separated from the toner image receiving body. Accordingly, in order to secure easy separation of the transfer material, the radius of curvature of the roller member at the end portion on the fixing device-side, around which the toner image receiving body is trained, is reduced and the curvature separation is carried out, or a transfer material separation means (AC discharger for paper separation) is provided for the electrostatic separation, however, there is a problem in which a separation failure occurs when environmental conditions are changed, or when thin paper is used.

Corresponding to this, it is considered that a separating claw to serve the separation of the transfer material from the second image bearing means is provided for ensuring the separation. However, there occurs a problem in which the transfer material after separation is in contact with the separation claw even while the transfer material is being fixed by the fixing means, therefore, an unfixed toner image on the transfer material, specifically the toner image on the reverse side is disturbed (rubbed), thereby, desirable double-sided images can not be formed. Reversely, a problem occurs in which unfixed toner adheres onto the separating claw when the back side image passes and the separation claw is stained.

Further, in the above image forming apparatus or image forming method, because the transfer material having unfixed toner images on both sides thereof is conveyed to the fixing device, the toner image receiving body is positioned adjacent to the fixing device, and the transfer material separated from the toner image receiving body is directly sent to the fixing device. However, when the toner image receiving body is positioned adjacent to the fixing device, problems occur in which the toner image receiving body is deformed by heat from the fixing device, or the toner image transferred onto the toner image receiving body is fused to some degree and thereby, sometimes transferring becomes difficult, or toner fixedly adheres onto the toner image receiving body. For this reason, it is considered that the second image bearing means and the fixing means are located apart from each other, and a conveyance means with a spurred wheel is located between them. However, in this case, there is a case in which the unfixed toner image on the transfer material, specifically the reverse side toner image is disturbed (rubbed), thereby, the double-sided images can not be finely formed. Further, depending on kinds of transfer materials, the transfer material separated from the toner image receiving body is not uniformly conveyed and conveyed irregularly, therefore, when the transfer material having unfixed toner images on both sides (also on the back side), which is separated from the toner image receiving body, is conveyed to the fixing device, there is also a problem in which the toner image on the reverse side is disturbed (rubbed), thereby, the double-sided images can not be finely formed.

SUMMARY OF THE INVENTION

An object of the present invention is to solve the above-described problems and to provide an image forming apparatus in which the transfer material is finely separated from the second image bearing means and is stably conveyed to the fixing means without the toner image on the back side being disturbed (rubbed). Further, another object of the present invention is to provide an image forming apparatus in which the following do not occur: the second image bearing means is deformed by the heat from the fixing means; the toner image on the second image bearing means is fused to some degree and thereby, transferring becomes difficult; or toner fixedly adheres onto the second image bearing means, and thereby the transfer material is stably conveyed to the fixing means without the toner image on the back side being disturbed (rubbed).

The above objects are attained by an image forming apparatus comprising: a first image bearing means for bearing a toner image formed by a toner image forming means; a second image bearing means for bearing the toner image which is transferred from the first image bearing means; a first transferring means for transferring the toner image borne by the first image bearing means onto the second image bearing means and a front side of a transfer material; a second transferring means for transferring the toner image borne by the second image bearing means onto a back side of the transfer material; and a fixing means for fixing toner images transferred onto both sides of the transfer material, wherein the transfer material is conveyed by the second image bearing means, and after the transfer material is separated from the second image bearing means, toner images transferred onto both sides of the transfer material are fixed by the fixing means, and wherein a separating claw for separating the transfer material from the second image bearing means is provided facing a roller positioned adjacent to the fixing means, around which the second image bearing means is trained, and is provided on a side of the second image bearing means with respect to a tangential plane of the roller passing a nip portion for nipping the transfer material of the fixing means.

The above objects are attained by an image forming apparatus comprising: a first image bearing means for bearing a toner image formed by a toner image forming means; a second image bearing means for bearing the toner image which is borne by the first image bearing means and transferred from the first image bearing means, on a front side of a transfer material and for conveying the transfer material; a first transferring means for transferring the toner image borne by the first image bearing means onto the second image bearing means or the front side of the transfer material; a second transferring means for transferring the toner image borne by the second image bearing means onto a back side of the transfer material; and a fixing means for fixing toner images transferred onto both sides of the transfer material, wherein a curvature portion is provided at an end portion of the second image bearing means on a side of the fixing means for separating the transfer material from the second image bearing means, a claw member is provided in the vicinity of the curvature portion, with which a leading edge of the transfer material is brought into contact, a first spurred wheel member having a plurality of protrusions on a circumferential surface thereof, is rotatably provided in the vicinity of the claw member and downstream side in a conveyance direction of the transfer material, for guiding a back side of the transfer material, a second spurred wheel member having a plurality of protrusions on a circumferential surface thereof, is rotatably provided between the first spurred wheel member and the fixing means, for guiding the back side of the transfer material, and wherein after the leading edge of the transfer material separated from the second image bearing means is brought into contact with the claw member, the first spurred wheel member picks up the leading edge and makes the leading edge advance toward the fixing means while making substantially constant an advancing direction of the leading edge toward the fixing means by the first and second spurred wheel members, and after the leading edge of the transfer material is picked up by the first spurred wheel member, the back side of the transfer material is prevented from being brought into contact with the claw member.

The above objects are attained by an image forming apparatus comprising: a first image bearing means for bearing a toner image formed by a toner image forming means; a second image bearing means for bearing the toner image which is borne by the first image bearing means and transferred from the first image bearing means, on a front side of a transfer material and for conveying the transfer material; a first transferring means for transferring the toner image borne by the first image bearing means onto the second image bearing means or the front side of the transfer material; a second transferring means for transferring the toner image borne by the second image bearing means onto a back side of the transfer material; and a fixing means for fixing toner images transferred onto both sides of the transfer material, wherein a plurality of claw members, a plurality of first rotatable spurred wheel members each having a plurality of protrusions on a circumferential surface thereof, and a plurality of second rotatable spurred wheel members each having a plurality of protrusions on a circumferential surface thereof, are respectively provided in the direction perpendicular to the conveyance direction of the transfer material sequentially from the upstream side in the conveyance direction of the transfer material between the second image bearing means and the fixing means, and wherein the following expression is satisfied: $H3 \leqq H2 < H1$, where H1 (mm) represents a minimum distance between an extension surface of a conveyance surface of the transfer material conveyed on the second image bearing means and the plurality of claw members, H2 (mm) represents a minimum distance between the extension surface and the plurality of first spurred wheel members, and H3 (mm) represents a minimum distance between the extension surface and the plurality of second spurred wheel members.

The above objects are attained by an image forming apparatus comprising: a first image bearing means for bearing a toner image formed by a toner image forming means; a second image bearing means for bearing the toner image which is borne by the first image bearing means and transferred from the first image bearing means, on a front side of a transfer material and for conveying the transfer material; a first transferring means for transferring the toner image borne by the first image bearing means onto the second image bearing means or the front side of the transfer material; a second transferring means for transferring the toner image borne by the second image bearing means onto a back side of the transfer material; and a fixing means for fixing toner images transferred onto both sides of the transfer material, wherein a plurality of claw members, a plurality of first rotatable spurred wheel members each having a plurality of protrusions on a circumferential surface thereof, and a plurality of second rotatable spurred wheel members each having a plurality of protrusions on a circumferential surface thereof, are respectively provided in the direction perpendicular to the conveyance direction of the transfer material sequentially from the upstream side in the conveyance direction of the transfer material between the second image bearing means and the fixing means, and wherein the following expression is satisfied: $r1<r2$, where r1 (mm) represents a radius of curvature of a circumferential surface of each of the plurality of first spurred wheel members, and r2 (mm) represents a radius of curvature of a circumferential surface of each of the plurality of second spurred wheel members.

The above objects are attained by an image forming apparatus comprising: a first image bearing means for bearing a toner image formed by a toner image forming means; a second image bearing means for bearing the toner image which is borne by the first image bearing means and transferred from the first image bearing means, on a front side of a transfer material and for conveying the transfer material; a first transferring means for transferring the toner image borne by the first image bearing means onto the second image bearing means or the front side of the transfer material; a second transferring means for transferring the toner image borne by the second image bearing means onto a back side of the transfer material; and a fixing means for fixing toner images transferred onto both sides of the transfer material, wherein a plurality of claw members, a plurality of first rotatable spurred wheel members each having a plurality of protrusions on a circumferential surface thereof, and a plurality of second rotatable spurred wheel members each having a plurality of protrusions on a circumferential surface thereof, are respectively provided in the direction perpendicular to the conveyance direction of the transfer material sequentially from the upstream side in the conveyance direction of the transfer material between the second image bearing means and the fixing means, and wherein the following expression is satisfied: $P1<P2$, where P1 (mm) represents a distance between adjacent protrusions of each of the plurality of first spurred wheel members, and P2 (mm) represents a distance between adjacent protrusions of each of the plurality of second spurred wheel members.

The above objects are attained by an image forming apparatus comprising: a first image bearing means for bearing a toner image formed by a toner image forming means; a second image bearing means for bearing the toner image which is borne by the first image bearing means and transferred from the first image bearing means, on a front side of a transfer material and for conveying the transfer material; a first transferring means for transferring the toner image borne by the first image bearing means onto the second image bearing means or the front side of the transfer material; a second transferring means for transferring the toner image borne by the second image bearing means onto a back side of the transfer material; and a fixing means for fixing toner images transferred onto both sides of the transfer material, wherein a plurality of claw members, a plurality of first rotatable spurred wheel members each having a plurality of protrusions on a circumferential surface thereof, and a plurality of second rotatable spurred wheel members each having a plurality of protrusions on a circumferential surface thereof, are respectively provided in the direction perpendicular to the conveyance direction of the transfer material sequentially from the upstream side in the conveyance direction of the transfer material between the second image bearing means and the fixing means, and wherein the following expression is satisfied: $d1<d2$, where d1 (mm) represents a minimum distance between an imaginary transverse section which is perpendicular to the conveyance surface of the transfer material conveyed by the second image bearing means and crosses a central portion of each of the plurality of claw members in the conveyance direction of the transfer material, and a circumferential surface of each of the plurality of first spurred wheel members which is closest to the transverse section, and d2 (mm) represents a minimum distance between the transverse section and a circumferential surface of each of the plurality of second spurred wheel members which is closest to the transverse section.

The above objects are attained by an image forming apparatus comprising: a first image bearing means for bearing a toner image formed by a toner image forming means; a second image bearing means for bearing the toner image which is borne by the first image bearing means and transferred from the first image bearing means, on a front side of a transfer material and for conveying the transfer material; a first transferring means for transferring the toner image borne by the first image bearing means onto the second image bearing means or the front side of the transfer material; a second transferring means for transferring the toner image borne by the second image bearing means onto a back side of the transfer material; and a fixing means for fixing toner images transferred onto both sides of the transfer material, wherein a plurality of claw members, a plurality of first rotatable spurred wheel members each having a plurality of protrusions on a circumferential surface thereof, and a plurality of second rotatable spurred wheel members each having a plurality of protrusions on a circumferential surface thereof, are respectively provided in the direction perpendicular to the conveyance direction of the transfer material sequentially from the upstream side in the conveyance direction of the transfer material between the second image bearing means and the fixing means, and wherein the following expression is satisfied: $W1 \leqq W2<W3$, where W1 (mm) represents a distance between two claws of the claw members which are most spaced from each other, W2 (mm) represents a distance between two spurred wheel members of the first spurred wheel members which are most spaced from each other, and W3 represents a distance between two spurred wheel members of the second spurred wheel members which are most spaced from each other.

The above objects are attained by an image forming apparatus comprising: a first image bearing means for bearing a toner image formed by a toner image forming means; a second image bearing means for bearing the toner image which is borne by the first image bearing means and transferred from the first image bearing means, on a front side of a transfer material and for conveying the transfer material; a first transferring means for transferring the toner image borne by the first image bearing means onto the second image bearing means or the front side of the transfer material; a second transferring means for transferring the toner image borne by the second image bearing means onto a back side of the transfer material; and a fixing means for fixing toner images transferred onto both sides of the transfer material, wherein a plurality of claw members, a plurality of first rotatable spurred wheel members each having a plurality of protrusions on a circumferential surface thereof, and a plurality of second rotatable spurred wheel members each having a plurality of protrusions on a circumferential surface thereof, are respectively provided in the direction perpendicular to the conveyance direction of the transfer material sequentially from the upstream side in the conveyance direction of the transfer material between the second image bearing means and the fixing means, and wherein the following expression is satisfied: $N1 \leqq N2$ and $N1+1 \leqq N3$, where N1 represents a number of the claw members in use, N2 represents a number of the first spurred wheel members in use, and N3 represents a number of the second spurred wheel members in use.

The above objects are attained by an image forming apparatus comprising: a first image bearing means for bearing a toner image formed by a toner image forming means; a second image bearing means for bearing the toner image which is borne by the first image bearing means and transferred from the first image bearing means, on a front side of a transfer material and for conveying the transfer material; a first transferring means for transferring the toner image borne by the first image bearing means onto the second image bearing means or the front side of the transfer material; a second transferring means for transferring the toner image borne by the second image bearing means onto a back side of the transfer material; and a fixing means for fixing toner images transferred onto both sides of the transfer material, wherein a plurality of claw members, a plurality of first rotatable spurred wheel members each having a plurality of protrusions on a circumferential surface thereof, and a plurality of second rotatable spurred wheel members each having a plurality of protrusions on a circumferential surface thereof, are respectively provided in the direction perpendicular to the conveyance direction of the transfer material sequentially from the upstream side in the conveyance direction of the transfer material between the second image bearing means and the fixing means, and a conveyance guiding member is provided between adjacent two second spurred wheel members and extends to the conveyance direction of the transfer material for guiding the back side of the transfer material.

The above objects are attained by an image forming apparatus comprising: a first image bearing means for bearing a toner image formed by a toner image forming means; a second image bearing means for bearing the toner image which is borne by the first image bearing means and transferred from the first image bearing means, on a front side of a transfer material and for conveying the transfer material; a first transferring means for transferring the toner image borne by the first image bearing means onto the second image bearing means or the front side of the transfer material; a second transferring means for transferring the toner image borne by the second image bearing means onto a back side of the transfer material; and a fixing means for fixing toner images transferred onto both sides of the transfer material, wherein a plurality of claw members, a plurality of first rotatable spurred wheel members each having a plurality of protrusions on a circumferential surface thereof, and a plurality of second rotatable spurred wheel members each having a plurality of protrusions on a circumferential surface thereof, are respectively provided in the direction perpendicular to the conveyance direction of the transfer material sequentially from the upstream side in the conveyance direction of the transfer material between the second image bearing means and the fixing means, and wherein the claw members and a supporting member for supporting the first spurred wheel members are integrally formed as a unit, and a surface of each of the claw members which is in contact with the transfer material is formed to be concave toward the back surface side of the transfer material.

BRIEF DESCRIPTION OF THE DRAWINGS

FIGS. 3(A), 3(B), and 3(C) are views showing conditions of both side toner image formation of the image forming apparatus according to the present invention.

DETAILED DESCRIPTION OF THE PREFERRED EMBODIMENT

In the description of following examples, a surface of a transfer material on a side facing a first image bearing means in a transfer area is referred to as a front side, a surface of the transfer material on the other side, that is on the side facing a second image bearing means, is referred to as a back side, an image transferred onto the front side of the transfer material is referred to as a front side image, and an image transferred onto the back side of the transfer material is referred to as the back side image.

Figure 1:
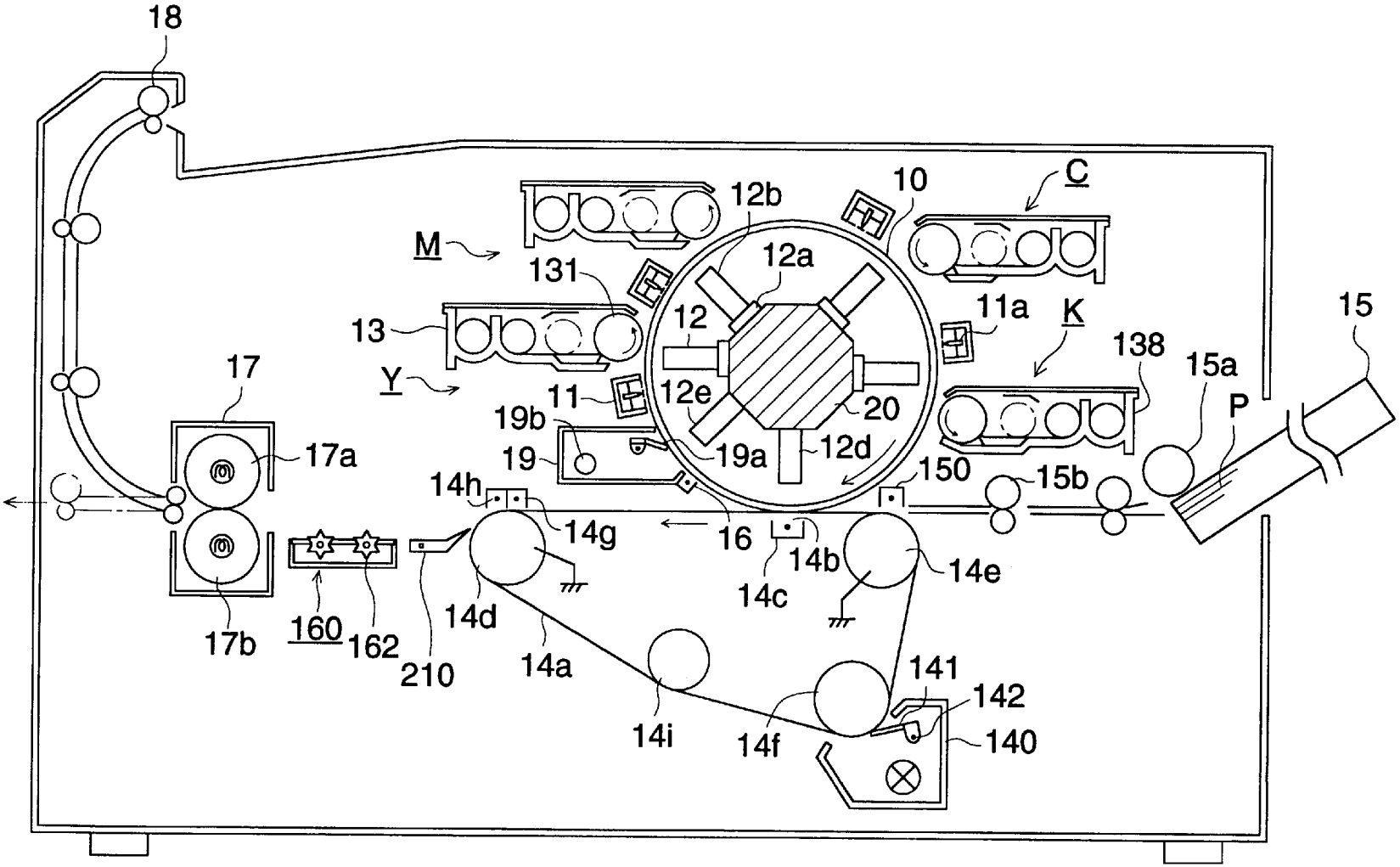
FIG. 1 is a sectional structural view of a color image forming apparatus showing an example of an image forming apparatus according to the present invention.
Figure 2:
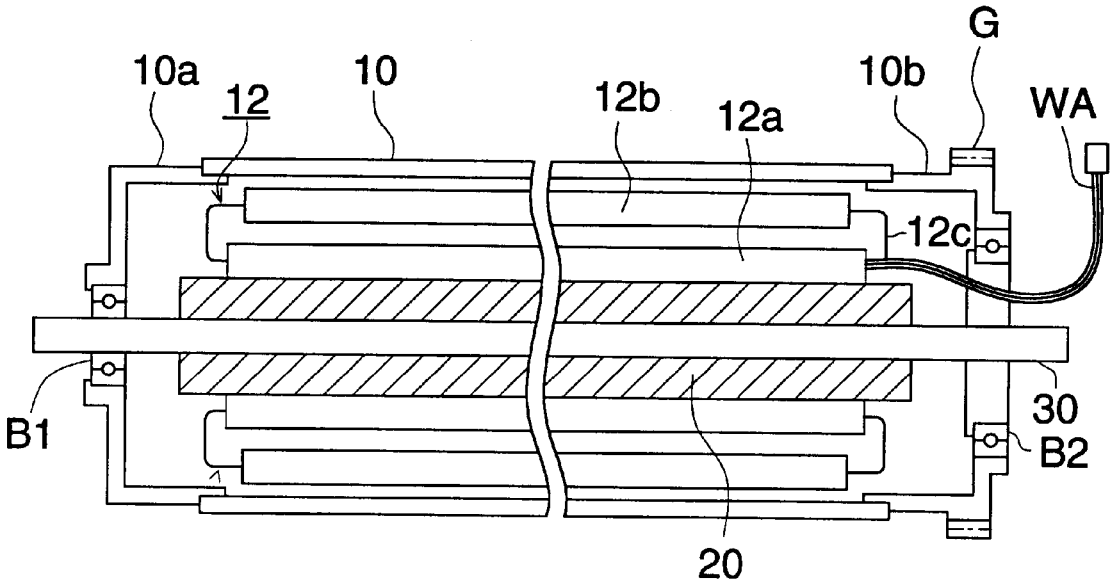
FIG. 2 is a sectional side view of a first image bearing means in FIG. 1.

Referring to FIG. 1 to FIGS. 3(A), 3(B) and 3(C), an image forming process and each mechanism of an example of an image forming apparatus according to the present invention will be described below. FIG. 1 is a sectional structural view of a color image forming apparatus showing an example of an image forming apparatus according to the present invention. FIG. 2 is a side sectional view of the first image bearing means in FIG. 1. FIGS. 3(A), 3(B) and 3(C) are views showing toner image forming conditions on both sides in the image forming apparatus according to the present invention. FIG. 3(A) is a view in which the toner image formed on the first image bearing means is transferred onto the second image bearing means and the back side image is formed. FIG. 3(B) is a view in which the front side image is formed on the first image bearing means in timed relationship with the back side image on the second image bearing means. FIG. 3(C) is a view showing both side image formation onto the transfer material.

In FIG. 1, numeral 10 is a photoreceptor drum serving as the first image bearing means, numeral 11 is a scorotron charger serving as a charging means for each color, numeral 12 is an exposure optical system serving as an image writing means for each color, numeral 13 is a developing device serving as a developing means for each color, numeral 14*a* is a toner image receiving body serving as the second image bearing means, numeral 14*c* is a transferring device serving as a first transferring means, numeral 14*g* is a back side transferring device serving as a second transferring means, numeral 150 is a paper charger serving as a transfer material charging means, numeral 14*h* is a paper separation AC discharger serving as a transfer material separating means, numeral 210 is a separating claw, numeral 160 is a conveying section having a spurred wheel 162, and numeral 17 is a fixing device serving as a fixing means.

The photoreceptor drum 10 which is the first image bearing means, is structured in such a manner that a photoreceptor layer such as a transparent conductive layer, a-Si layer or organic photoreceptor layer (OPC) is formed on the outer periphery of a cylindrical base body formed of a transparent member such as, for example, optical glass, transparent acrylic resin, or the like, and is rotated clockwise as shown by an arrow in FIG. 1, while the conductive layer is electrically grounded.

As shown in FIG. 2, the photoreceptor drum 10 is rotatably supported by bearings B1 and B2, which are embedded in flange members 10*a* and 10*b* on both end portions with which the photoreceptor drum 10 is engaged for being fixed, with respect to a drum shaft 30 fixed by the apparatus main body, and is rotated at constant speed in a predetermined direction when a gear G integrated with the flange member 10*b* is engaged with a driving gear, not shown, on the apparatus main body side and is driven.

The scorotron charger 11 which is a charging means for each color, the exposure optical system 12 which is the image writing means for each color, and the developing device 13 which is the developing means for each color are formed into a set, and 4 sets are prepared for the image forming process for each color of yellow (Y), magenta (M), cyan (C) and black (K) and arranged in the order of Y, M, C, K in the rotational direction of the photoreceptor drum 10 shown by an arrow in FIG. 1.

The scorotron charger 11 for each color has a control grid having a predetermined potential voltage and a discharging electrode 11*a* formed of, for example, a saw tooth-shaped electrode, and is mounted facing the photoreceptor layer of the photoreceptor drum 10, conducts charging action (negative charging in the present example) by corona discharging with the same polarity as that of toner, and applies uniform potential voltage onto the photoreceptor drum 10. As the discharging electrode 11*a,* a wire electrode or a needle-shaped electrode may be used.

The exposure optical system 12 which is the image wrting means for each color is located inside the photoreceptor drum 10 in such a manner that the exposure position on the photoreceptor drum 10 is positioned at a downstream side in the rotational direction of the photoreceptor drum 10 with respect to the above-described scorotron charger 11 for each color. As shown in FIG. 2, each exposure optical system 12 is an exposure unit structured by a linear exposure element 12*a* in which a plurality of LEDs (light emitting diodes) as a light emitting element of image exposure light are arranged array-like in the primary scanning direction in parallel with the drum shaft 30, a light converging light transmission body (trade name: Selfoc lens array) 12*b* as an image forming element, and a lens holder 12*c,* and mounted on a holding member 20. Other than exposure optical system 12 for each color, a transfer simultaneous exposure unit 12*d* and a uniform exposure unit 12*e* are also mounted on the holding member 20, and integrally accommodated inside the light transmissive base body of the photoreceptor drum 10. The exposure optical system 12 for each color image-wise exposes the photoreceptor layer of the photoreceptor drum from its back side according to image data for each color which is read by an image reading device separately provided from the apparatus and stored in a memory, and forms an electrostatic latent image on the photoreceptor drum 10. As the exposure element 12*a,* other than the above element, an exposure element may also be used in which a plurality of light emitting elements such as an FL (fluorescent substance light emission), EL (electroluminescence), PL (plasma discharge), etc., are arranged array-like. As the wavelength of light emission of the light emitting element for image-wise exposure light, the wavelength within the range of 780–900 nm in which normally the permeability is high for toner of Y, M, C, is used, however, in the present example, image-wise exposure is conducted from the back side, therefore, the wavelength of 400–780 nm in which the permeability is not so high for color toner may also be allowable. In FIG. 2, WA represents a lead wire from the light emitting element (LED) of the image-wise exposure means.

The developing device 13 which is the developing means for each color has a developing sleeve 131 which keeps a predetermined gap with respect to the circumferential surfce of the photoreceptor drum 10 and which is formed of, for example, 0.5–1 mm thick and 15–25 mm outer diameter cylindrical non-magnetic stainless steel or aluminum material and is rotated in the same direction as the rotational direction of the photoreceptor drum 10, and a developing casing 138, and one-component or two-component developer of yellow (Y), magenta (M), cyan (C) and black (K) is accommodated therein. Each developing device 13 is kept non-contact with the photoreceptor drum 10 with a predetermined gap of, for example, 100–500 $\mu$m, and when developing bias voltage in which AC voltage is superimposed on DC voltage, is applied on the developing sleeve 131, non-contact reversal development is conducted and a toner image is formed on the photoreceptor drum 10.

The toner image receiving body 14*a* which is the second image bearing means is an endless belt having $10^{12}$–$10^{15}\Omega\cdot$cm volume resistivity, and two-layer construction seamless belt in which, for example, preferably, as a toner filming prevention layer, 5–50 $\mu$m fluorine coating is made outside 0.1–1.0 mm semi-conductive film base body which is formed by dispersing conductive material in engineering plastic such as modified polyimide, thermosetting polyimide, ethylenetetrafluoro ethylene copolymer, polyvinyliden fluoride, nylon alloy, etc. As the base body of the belt, other than the above, 0.1–2.0 mm thick semi-conductive rubber belt which is formed by dispersing conductive material in silicon rubber or urethane rubber, may also be used. The toner image receiving body 14*a* is inscribed by a drive roller 14*d* which is a roller member, driven roller 14*e*, guide roller 14*f* and tension roller 14*i*, trained around them, and rotated counterclockwise as shown by an arrow in FIG. 1. These rollers are provided in order of the driven roller 14*e*, drive roller 14*d*, tension roller 14*i*, and guide roller 14*f* in the rotational direction of the toner image receiving body 14*a*, and the driven roller, drive roller 14*d* and guide roller 14*f* are rotated at a fixed position, and the tension roller 14*i* is rotated while stretching the toner image receiving body 14*a* by a spring force of a spring or the like, not shown, of the toner image receiving body 14*a*. When a drive motor M1 (refer to FIG. 4) is driven, the drive roller 14*d* is rotated, and the toner image receiving body 14*a* is rotated. By the rotation of the toner image receiving body 14*a*, the driven roller 14*e*, guide roller 14*f*, and tension roller 14*i* are driven. The looseness of the belt of the toner image receiving body 14*a* during rotation, is strained by the tension roller 14*i*.

The transferring device 14*c* which is the first transferring means preferably composed of a corona discharger, is provided opposite to the photoreceptor drum 10 through the toner image receiving body 14*a*, and a transfer area 14*b* is formed between the toner image receiving body 14*a* and the photoreceptor drum 10. DC voltage with the reverse polarity to the toner (in the present example, positive polarity) is applied onto the transferring device 14*c*, and by forming the transfer electric field in the transfer area 14*b*, the toner image on the photoreceptor drum 10 is transferred onto the toner image receiving body 14*a* or the front side of a recording sheet P which is a transfer material.

The back side transferring device 14*g* which is the second transferring means preferably composed of a corona discharger, is provided opposite to the conductive drive roller 14*d* electrically grounded through the toner image receiving body 14*a*, and DC voltage with the reverse polarity to toner (in the present example, positive polarity) is applied onto the back side transferring device 14*g*, thereby, the toner image on the toner image receiving body 14*a* is transferred onto the back side of the recording sheet P.

A paper charger 150 which is a transfer material charging means preferably composed of a corona discharger is provided opposite to the electrically grounded driven roller 14*e* though the toner image receiving body 14*a*, and the recording sheet P is charged and attracted to the toner image receiving body 14*a*.

A paper separation AC discharger 14*h* as a transfer material separation means preferably composed of a corona discharger, is provided as needed opposite to the electrically grounded conductive drive roller 14*d* though the toner image receiving body 14*a* at an end portion of the toner image receiving body 14*a* on the fixing device 17 side, and AC voltage on which DC voltage with the same polarity as or the reverse polarity to toner is superimposed as needed is applied on the paper separation AC discharger 14*h* and the recording sheet P conveyed by the toner image receiving body 14*a* is discharged and separated from the toner image receiving body 14*a*.

A separation claw 210 is provided between the toner image receiving body 14*a* and a conveying section 160, rotated around a support shaft 221 as a rotation support shaft, and is in close to or released from the toner image receiving body 14*a* and helps the separation of the recording sheet P from the toner image receiving body 14*a*. For the separation claw 210, resin molding members formed of resins having good mold releasability or good abrasion resistance, such as, for example, Teflon, polyimide, or polycarbonate resins are used. The recording sheet P separated from the toner image receiving body 14*a* is conveyed onto the supped wheel 162 of the conveying section 160.

The conveying section 160 is provided between the toner image receiving body 14*a* and the fixing device 17, and the spurred wheel 162 is provided on the upper surface of the conveying section 160. The spurred wheel 162 picks the recording sheet P which is going to be conveyed curving toward the toner image receiving body 14*a* when the recording sheet P is separated from the toner image receiving body 14*a*, and the recording sheet P with the toner image on its back side is conveyed to the fixing device 17 while the back side toner image is prevented from being disturbed.

The fixing device 17 as the fixing means is composed of 2 roller-like fixing members of a fixing roller 17*a* having a heater therein, and a pressure contact roller 17*b*, and the toner image on the recording sheet P is fixed when heat and pressure are applied thereon in a nip portion T formed between the fixing roller 17*a* and the pressure contact roller 17*b*.

Next, the image forming process will be described.

When image recording is started, the photoreceptor drum 10 is rotated clockwise as shown by an arrow in FIG. 1, by the start of a photoreceptor drum driving motor, not shown in the drawings, and simultaneously, potential voltage starts to be applied on the photoreceptor drum 10 by a charging action of a yellow (Y) scorotron charger 11.

After potential voltage has been applied onto the photoreceptor drum 10, image writing by an electric signal corresponding to the first color signal, that is, Y image data is started by the Y exposure optical system 12, and an electrostatic latent image corresponding to the Y image of the document image is formed on the surface of the photoreceptor drum 10.

The latent image is reversal-developed under non-contact condition by the Y developing device 13, and a yellow (Y) toner image is formed on the photoreceptor drum 10.

Next, the potential voltage is applied on the Y toner image formed on the photoreceptor drum 10 by a charging action of a magenta (M) scorotron charger 11, and image writing by an electric signal corresponding to the second color signal, that is, the M image data is conducted by an M exposure optical system 12, and a magenta (M) toner image is formed on the yellow (Y) toner image by superimposition, by non-contact reversal development by an M developing device 13.

In the same process, a cyan (C) toner image corresponding to the third color signal is further formed by superimposition, by a cyan (C) scorotron charger 11, C exposure optical system 12 and C developing device 13, and further a balck (K) toner image corresponding to the fourth color signal is successively formed by superimposition on the above toner images, by a black (K) scorotron charger 11, K exposure optical system 12 and K developing device 13. Then, a superimposed color toner image of four colors of yellow (Y), magenta (M), cyan (C) and black (K) is formed on the peripheral surface of the photoreceptor drum 10 during its single rotation, (a toner image forming means).

The image writing onto the photoreceptor layer of the photoreceptor drum 10 by the Y, M, C, K exposure optical system 12 is conducted through the transparent base body from the inside of the drum. Accordingly, image writing corresponding to the second, third and fourth color signals is conducted with completely no influence by any previously formed toner image, thereby, the electrostatic latent image having the same quality as the image corresponding to the first color signal can be formed.

By the above image forming process, a superimposed color toner image, which is a back side image, formed on the photoreceptor drum 10, seving as the first image bearing means, is collectively transferred onto the toner image receiving body 14*a,* serving as the second image bearing means, by the transferring device 14*c,* serving as the first transferring means, in the transfer area 14*b* (FIG. 3(A)). In this case, uniform exposure by the transfer simultaneous exposure device 12*d* provided inside the photoreceptor drum 10 may be conducted so that fine transferring can be carried out.

Toner remaining on the circumferential surfce of the photoreceptor drum 10 after transferring, is discharged by a photoreceptor drum AC discharger 16, and after that, moved to a cleaning device 19 as a first image bearing means cleaning means, cleaned by a cleaning blade 19*a* formed of rubber material in contact with the photoreceptor drum 10, and is collected into a waste toner container, not shown, by a screw 19*b*. Further, the peripheral surface of the photoreceptor drum 10 is exposed by a pre-charging uniform exposure device 12*e* using, for example, light emitting diodes, and hysteresis of the photoreceptor drum 10 due to previous image formation, is eliminated.

As described above, after a superimposed color toner image, which is a back side image, has been formed on the toner image receiving body 14*a,* successively, in the same manner as the above color image forming process, a superimposed color toner image which is a front side image, is formed on the photoreceptor drum 10 (FIG. 3(B)). In this case, image data is changed so that the front side image formed on the photoreceptor drum 10 forms a mirror image with respect to the back side image previously formed on the photoreceptor drum 10.

According to the front side image formation onto the photoreceptor drum 10, the recording sheet P, serving as the transfer material, is sent from a sheet feed cassette 15, which is a transfer material accommodation means, by a feeding roller 15*a,* conveyed to a timing roller 15*b,* which is a transfer material feeding means, and the recording sheet P is in timed relationship with the color toner image of the front side image borne on the photoreceptor drum 10, and the color toner image of the back side image borne on the toner image receiving body 14*a,* by the drive of the timing roller 15*b,* and is sent to the transfer area 14*b*. In this case, the recording sheet P is paper-charged to the same polarity as toner by a paper charger 150 which is provided on the front surface side of the sent recording sheet P, and onto which DC voltage with the same polarity as toner (in the present example, negative polarity) is applied, and is attracted to the toner image receiving body 14*a* and sent to the transfer area 14*b*. By paper charging the recording sheet to the same polarity as the toner, the recording sheet P and the toner image on the toner image receiving body 14*a* or the toner image on the photoreceptor drum 10, are prevented from being attracted to each other, and thereby, the toner image is prevented from being disturbed. In this connection, except the case in which the paper charger 150 is used for the second image bearing means charging means, which will be described later, ordinary, application of voltage onto the paper charger 150, which is the transfer material charging means, is conducted only when the recording sheet P is sent, and simultaneously with the passage of recording sheet P, the voltage applied onto the paper charger 150 is cut off. As the paper charger 150, a paper charging brush or a paper charging roller may also be used other than a corona discharger.

In the transfer area 14*b,* the front side image on the photoreceptor drum 10 is collectively transferred onto the front side of the recording sheet P by the transferring device 14*c* as the first transferring means onto which voltage with reverse polarity to toner (in the present example, positive polarity) is applied. At this time, the back side image on the toner image receiving body 14*a* is not transferred onto the recording sheet P, but exists on the toner image receiving body 14*a*. Uniform exposure may be conducted by the transfer simultaneous exposure device 12*d,* which is provided inside the photoreceptor drum 10, opposite to the transfer area 14*b,* using, for example, light emitting diodes so that transferring can be finely conducted in the case of transferring by the transfer device 14*c*.

The recording sheet P, onto the front side of which the color toner image has been transferred, is conveyed to a back side transferring device 14*g* as the second transferring means onto which voltage with the reverse polarity to toner (in the present example, positive polarity) is applied, and the back side image on the circumferential surfce of the toner image receiving body 14*a* is collectively transferred onto the back side of the recording sheet P by the back side transferring device 14*g* (FIG. 3(C)).

The recording sheet P, onto both sides of which the color toner images are transferred, is separated from the toner image receiving body 14*a* by the curvature of a driving roller 14*d* to drive the toner image receiving body 14*a,* discharging action of the paper separation AC discharger 14*h* as the transfer material separation means which is provided at need at an end portion of the toner image receiving body 14*a,* and a separation claw 210 which is in close to the recording sheet P. The recording sheet P is conveyed to the fixing device 17 as the transferring means through the conveying section 160 in which the spurred wheel 162 is provided, and when heat and pressure are applied thereon at a nip portion T formed between the fixing roller 17*a* and the pressure contact roller 17*b,* the toner image on the recording sheet P is fixed. The recording sheet P on which both side image recording has been conducted, is sent while the front side and the back side are reversed, and is delivered onto a tray provided outside the apparatus by a discharging roller 18. Further, as shown by a one-dotted chain line in FIG. 1, a switching member, not shown, may be provided at an exit of the fixing device 17 so that the recording sheet P is delivered onto the tray provided outside the apparatus. The separating claw 210 is in a release condition at least while the toner image of the back side image on the toner image receiving body 14*a* passes.

Toner, remaining on the peripheral surface of the toner image receiving body 14*a* after transferring, is cleaned by a toner image receiving body cleaning device 140, which is the second image bearing means cleaning means provided opposite to a guiding roller 14*f* through the toner image receiving body 14*a* and which has a toner image receiving body cleaning blade 141, which can be rotated around the support shaft 142 and can be in close to and released from the toner image receiving body 14*a.*

Toner, remaining on the circumferential surfce of the photoreceptor drum 10 after transferring, is discharged by a photoreceptor drum AC discharger 16, after that, the residual toner is removed by the cleaning device 19, hysteresis of the photoreceptor drum 10 due to previous image formation is eliminated by the pre-charging uniform exposure device 12*e,* and the photoreceptor drum 10 enters the next image forming cycle.

By applying the above-described method, the superimposed color toner image is collectively transferred onto the recording sheet P, thereby doubling of the color image, scattering of toner, or frictional damage on the toner image receiving body 14*a* hardly occurs, and therefore, a fine both side color image having smaller image deterioration, can be formed.

Incidentally, the above description is made for a color image forming apparatus as an example of the double-sided image forming apparatus, however, the present invention is not limited to this, but can also be applied to a monochromatic double-sided image forming apparatus using the same process as described in FIG. 1.

Further, in the image forming apparatus of the present invention, other than the double-sided image formation by which images are formed on both sides of the transfer material as described in the above example, of course, the single side image formation can also be conducted by which an image is formed on only a single side, that is, only the front side or back side of the transfer material.

Figure 4:
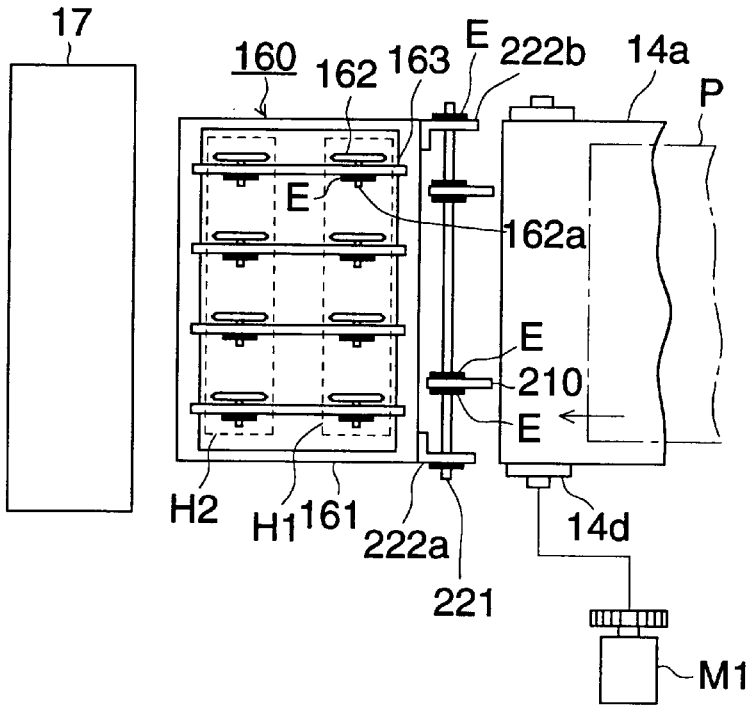
FIG. 4 is a view showing separating claws and conveyance section.
Figure 5:
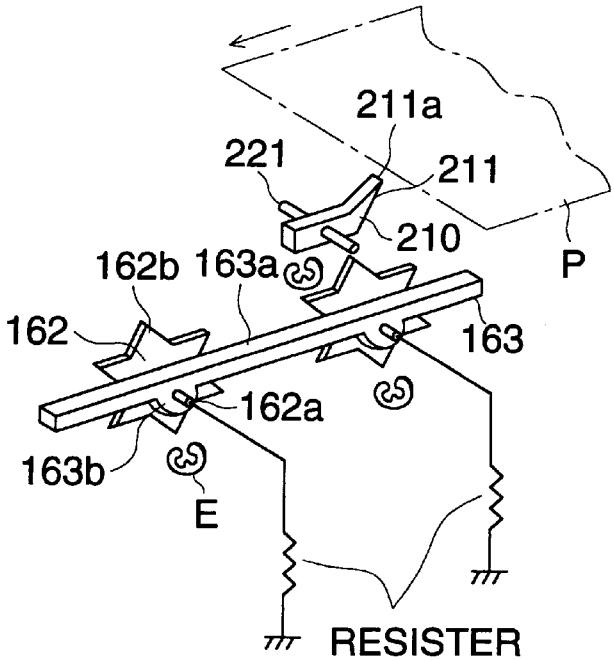
FIG. 5 is a perspective view of a main portion of FIG. 4.
Figure 6:
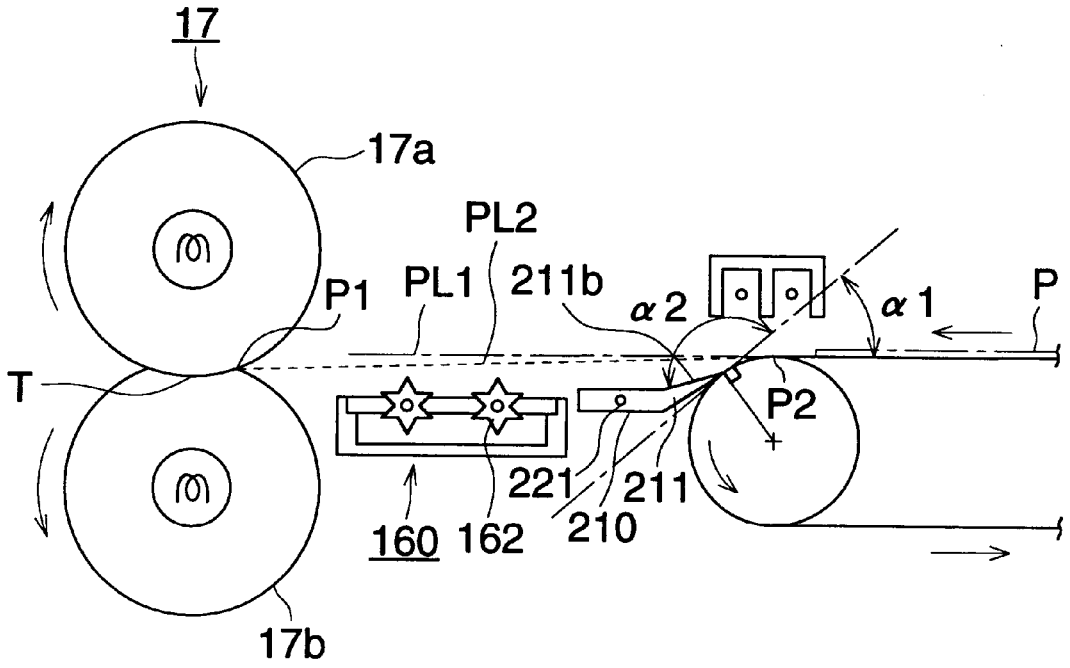
FIG. 6 is a view showing a positional relationship of the separating claw and a second image bearing means.

The conveying section having the separating claw and the spurred wheel according to the present invention will be described below, referring to FIGS. 4, 5, 6 and 1. FIG. 4 is a view showing the separating claw and the conveying section, FIG. 5 is a perspective view of a main portion of FIG. 4, and FIG. 6 is a view showing the positional relationship between the separating claw and the second image bearing means.

The recording sheet P on which the toner image of the front side image and the toner image of the back side image are formed, is conveyed by the toner image receiving body 14*a* moved by the drive roller 14*d* which is a roller member rotated by a driving motor M1. The conveying section 160 provided with the separating claw 210 and the supped wheel 162, is arranged between the toner image receiving body 14*a* and the fixing device 17 in its order, on the back side of the recording sheet P and lower than the transfer material conveyance surfce of the toner image receiving body 14*a* or its extended surface PL1 (hereinafter, called the transfer material conveying surface PL1), and further, on the back side of the recording sheet P and lower than a surface PL2, which includes a point P1 on the entry side of the recording sheet P at a fixing nip portion (nip portion) T of the fixing device 17 and is tangent to an upper portion P2 (a position at which the toner image receiving body 14*a* begins to have the curvature) of the drive roller 14*d* which is a roller member on the fixing device 17 side, around which the toner image receiving body 14*a* is trained. The recording sheet P separated from the toner image receiving body 14*a* by the separating claw 210 is conveyed through the conveying section 160 to the fixing device 17 vertically provided with the fixing roller 17*a* and pressure-contact roller 17*b.*

By arranging the separating claw in the above-described arrangement, even if the transfer material separated by the separating claw is in contact with the separating claw just after the separation, the transfer material is easily separated from the separating claw when the transfer material is conveyed by the fixing means, thereby, it can be avoided that the separating claw continues to be in contact with the transfer material. Accordingly, the transfer material is finely separated from the toner image receiving body 14*a,* and thereby, the transfer material can be stably conveyed to the fixing means without the back side toner image being disturbed (rubbed).

A central shaft 162*a* integrally provided with the spurred wheel 162 is inserted into a hole of a semi-circular stopping portion 163*b* provided on the opposite side of the guiding surface 163*a* of the conveyance guiding member 163, a tip of the central shaft 162*a* is engaged with E-ring E, and the spurred wheel 162 is rotatably attached to the conveyance guiding member 163. A plurality of the conveyance guiding members on which the spurred wheel 162 is attached are assembled in the conveyance section casing 161, and thus, the conveying section 160 is structured.

A plurality of spurred wheels 162 are provided as sets of spurred wheels H1 and H2 in the direction perpendicular to the conveyance direction of the recording sheet P. At least one set of spurred wheels is provided.

The guiding surface 163*a* of the conveyance guiding member 163 is provided on a transfer material conveyance surfce side higher than the rotation center of the spurred wheel 162. According to this, even when the leading edge of the recording sheet P separated from the toner image receiving body 14*a* by the separating claw 210 and conveyed onto the spurred wheel 162, comes into contact with the guiding surface 163*a,* the recording sheet P is picked up by the guiding surface 163*a,* sent onto the spurred wheel 162, and the spurred wheel is rotated under the condition that the protrusion 162*b* of the spurred wheel 162 is in contact with the recording sheet P, or sticks it, thereby, the recording sheet P is conveyed to the fixing device 17 without the toner image being rubbed.

As the spurred wheel 162, a 0.05–0.5 mm thick, 5–25 mm outer diameter spurred wheel into which metallic plate such as stainless plate or copper plate is etching processed, or a 0.5–2.0 mm thick, 5–25 mm outer diameter spurred wheel formed of insulating resin member, is used, and the spurred wheel is formed of a polygonal, for example, hexagonal plate member in which a sharp protrusion 162*b* is provided at a tip portion. When the spurred wheel 162 is made of metallic plate, it is preferably electrically grounded through a resistor of $10^8$–$10^{14}\Omega$. The reason why the spurred wheel 162 is electrically grounded through the metallic plate and a high resistance or a high resistance member, is that toner or the transfer material has electric charges, and therefore, electric charge accumulation on the spurred wheel 162 or toner adhesion to the spurred wheel 162 due to a mirror image force, is prevented by discharging, thereby, a toner image is prevented from being disturbed. In the same manner, toner adhesion is prevented by making the metallic plate in an insulated condition by electrically floating it, thereby, the toner image can also be prevented from being disturbed. Further, the toner adhesion is prevented by applying voltage with the same polarity as toner (in the present example, negative polarity) onto the metallic plate, thereby, the toner image can also be prevented from being disturbed. When an insulating member such as an insulating resin member, etc., is used for the spurred wheel 162, electric charge accumulation on the spurred wheel or toner adhesion to the spurred wheel by a mirror image force can also be prevented by discharging in the same manner as in the floating, thereby, the toner image can be prevented from being disturbed.

As described above, a separability increasing method is used before paper separation by providing a paper discharging mechanism using a corona discharger such as the paper separation AC discharger 14*h*, which is the transfer material separating means, at need. However, problems such as granular appearance of the front image by discharging, a transfer failure due to interference with back side transfer discharging, etc., occur. Accordingly, in the present example, the paper separation AC discharger 14*h* is not used, but curvature separation by the driving roller 14*d* around which the toner image receiving body is trained, is preferably used. As the driving roller 14*d*, a driving roller of 10–40 mm outer diameter is commonly used so that the curvature separation can be finely conducted, and further, the separation claw 210 is jointly used with the roller so that the recording sheet P can be securely separated.

The separating claw 210 located between the toner image receiving body 14*a* and the conveying section 160 is mounted on the support shaft 221, both sides of the separating claw 210 are fastened with the E-rings E, and it is held on the support shaft 221. The support shaft 221 is fixed in holders 222*a* and 222*b* provided, for example, on both ends of the conveying section, and thus, the separating claw 210 is arranged. The separating claw 210 is rotated around the support shaft 211 and is in close condition to or release condition from the toner image receiving body 14*a*, which will be described later.

A claw portion 211 for separating the recording sheet P is provided on the separating claw 210, and the recording sheet P is separated by a tip portion 211*a* of the claw portion 211 in the close condition to the toner image receiving body 14*a*.

In FIG. 6, in the close condition of the separating claw 210, an angle $\alpha 1$ formed between a tangential line PL3 at a close position of the toner image receiving body 14*a*, trained around the driving roller 14*d*, with the tip portion 211*a* of the separating claw 210, and a transfer material conveyance surfce PL1 of the toner image receiving body 14*a*, is preferably more than 20° and less than 50°. When the angle $\alpha 1$ is not larger than 20°, that is, the tip portion of the separating claw 210 is close to the upper most portion of the driving roller 14*d* in the separating section, the peeling force by the curvature of the driving roller 14*a* can hardly be used, therefore, a load burdened on the separating claw 210 is large, and simultaneously, the toner image receiving body is easily damaged. Further, when the angle $\alpha 1$ is larger than 50°, that is, the tip portion 211*a* is positioned too low, the conveyance direction of the recording sheet P after separation is directed downward, after that, the direction is changed toward the fixing device 17, and it is necessary to lift up the recording sheet P to the height of a point P1 of the nip portion T, thereby conveyance failure easily occurs.

Further, in the close condition of the separating claw 210, an angle $\alpha 2$ formed between the tangential line PL3 at a close position of the toner image receiving body 14*a* trained around the driving roller 14*d*, with the tip portion 211*a* of the separating claw 210, and a separating surface 211*b*, which is a surface of the claw portion 211 of the separating claw 210 on the transfer material conveying surface PL1 side, is preferably more than 90° and less than 150°. When the tip portion 211*a* of the separating claw 210 is in close to the toner image receiving body 14*a* at an angle $\alpha 2$ smaller than 90° (specifically at a rather acute angle), the recording sheet p is easily caught by the tip portion 211*a* of the separating claw 210, and when the tip portion 211*a* of the separating claw 210 is in close to the toner image receiving body 14*a* at the angle $\alpha 2$ larger than 150°, the conveyance direction of the recording sheet P after separation is directed downward too much, thereby, the recording sheet p after separation is not finely conveyed.

Due to the above description, the recording sheet P with unfixed images on both sides thereof, which is separated from the toner image receiving body 14*a*, is stably conveyed to the fixing device 17 through the conveying section 160 without the toner image of the back side image being disturbed.

Figure 7:
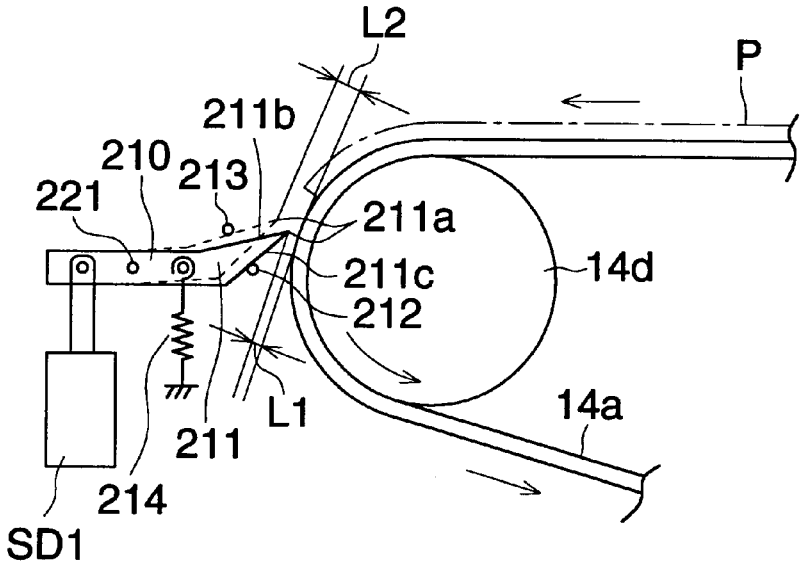
FIG. 7 is a view showing a close and release mechanism of the separating claw, and intervals between the separating claw and the second image bearing means under the close or release conditions.

The close and release mechanism of the separating claw is shown in FIG. 7. FIG. 7 is a view showing the close and release mechanism of the separating claw, and an interval between the separating claw and the second image bearing means in the close or release condition of the separating claw.

According to FIG. 7, the separating claw 210 can be rotated around the support shaft 221, the tip portion 211*a* of the claw portion 211 is rotated clockwise in FIG. 7 by a spring 214, and the surface 211*c* opposite to the separating surface 211*b* of the claw portion 211 comes into contact with a pin 212 which is a stopper, and thus, the separating claw 210 is in the close condition. Further, by an operation of a solenoid SD1 provided on the opposite side of the tip portion 211*a* with respect to the support shaft 221, the tip portion 211*a* of the claw portion 211 is rotated counterclockwise, and the separating surface 211*b* of the claw portion 211 comes into contact with a pin 213 which is a stopper, as shown by a dotted line in FIG. 7, then, the separating claw 210 is in the release condition. At least, during passage of the back side image on the toner image receiving body 14*a*, the separating claw 210 is in the release condition.

In the close condition, the closest distance L1 between the toner image receiving body 14*a* and the tip portion 211*a* of the separating claw 210 is preferably not more than 0.5 mm, and more preferably 0.1–0.3 mm. When the closest distance L1 is not more than 0.5 mm, passing through the distance of the recording sheet P at the tip portion 211*a* does not occur in the close condition of the separating claw 210, and the recording sheet P is finely separated from the toner image receiving body 14*a*. Further, in the release condition, the closest distance L2 between the toner image receiving body 14*a* and the tip portion 211*a* of the separating claw 210 is preferably not less than 0.5 mm. When the closest distance L2 is not less than 0.5 mm, toner adhesion of the toner image of the back side image on the toner image receiving body 14*a* which passes through in close proximity to the tip portion 211*a,* onto the separating claw 210, caused by the electrostatic force can be prevented.

Due to the above description, slipping-off of the recording sheet P at paper separation does not occur and the recording sheet P is finely separated from the toner image receiving body 14*a,* and further, the separating claw 210 can be prevented from being stained by toner. Fine separability can be obtained in the process in which unfixed images are formed on both sides of the recording sheet P, and further, the image is not disturbed during paper separation.

Figure 8:
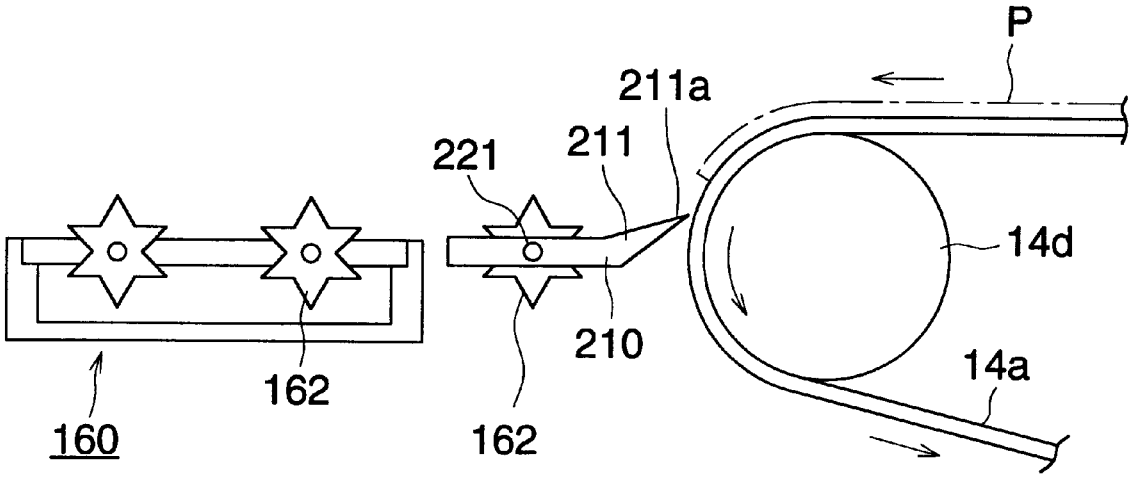
FIG. 8 is a view showing a unit in which the separating claw and a spurred wheel are integrated with each other.

A component in which the separating claw for separating the transfer material from the second image bearing means and the spurred wheel for conveying the transfer material separated by the separating claw are integrally provided, will be described referring to FIG. 8. FIG. 8 is a view showing the component in which the separating claw and the spurred wheel are integrally provided.

As shown in FIG. 8, the separating claw 210 for separating the recording sheet P from the toner image receiving body 14*a* and the spurred wheel 162 of a set closest to the driving roller 14*d* in the above-described spurred wheels are integrally provided. When the spurred wheel 162 is integrally provided with the separating claw 210, after the recording sheet P is peeled from the toner image receiving body 14*a* by the tip portion 211*a* of the claw portion 211 of the separating claw 210, the recording sheet P is separated at once from the separating claw 210 and guided by the spurred wheel integrally provided with the separating claw, and is relayed to the spurred wheel 162 of the conveying section 160 located on the fixing device 17 side, succeeding to the separating claw 210 and conveyed, in the same manner as described in FIGS. 4 and 5. Therefore, the recording sheet P after separation is finely conveyed to the fixing device 17, the toner image of the back side image on the recording sheet P is hardly disturbed, and the separating claw 210 is hardly stained also.

Further, in the same manner as described in FIGS. 4 and 5, in order to prevent the toner adhesion of the back side image, it is preferable that the spurred wheel 162 is made to be electrically floating from the image forming apparatus main body, or electrically charged with the same polarity as toner. Further, it is also preferable that the spurred wheel 162 is formed of an insulating member, or electrically grounded through a high resistance member.

According to the present invention, the transfer material separated from the second image bearing means is finely conveyed to the fixing device.

According to the pre sent invent ion, slipping off of the transfer material at the paper separation does not occur, the transfer material is finely separated from the second image bearing means, and the separating claw is prevented from being stained by toner.

Further, according to the present invention, the transfer material is separated at once from the separating claw, and is guided by the spurred wheel integrally provided with the separating claw, and therefore, the toner image of the back side image on the transfer material is prevented from being disturbed, contact time of the transfer material with the separating claw is instantaneous, and conveyance of the transfer material is relayed to the spurred wheel integrally provided with the separation claw, thereby, the separating claw is hardly stained.

Still further, according to the present invention, the spurred wheel is prevented from being stained by adhesion of the back side toner.

Figure 9:
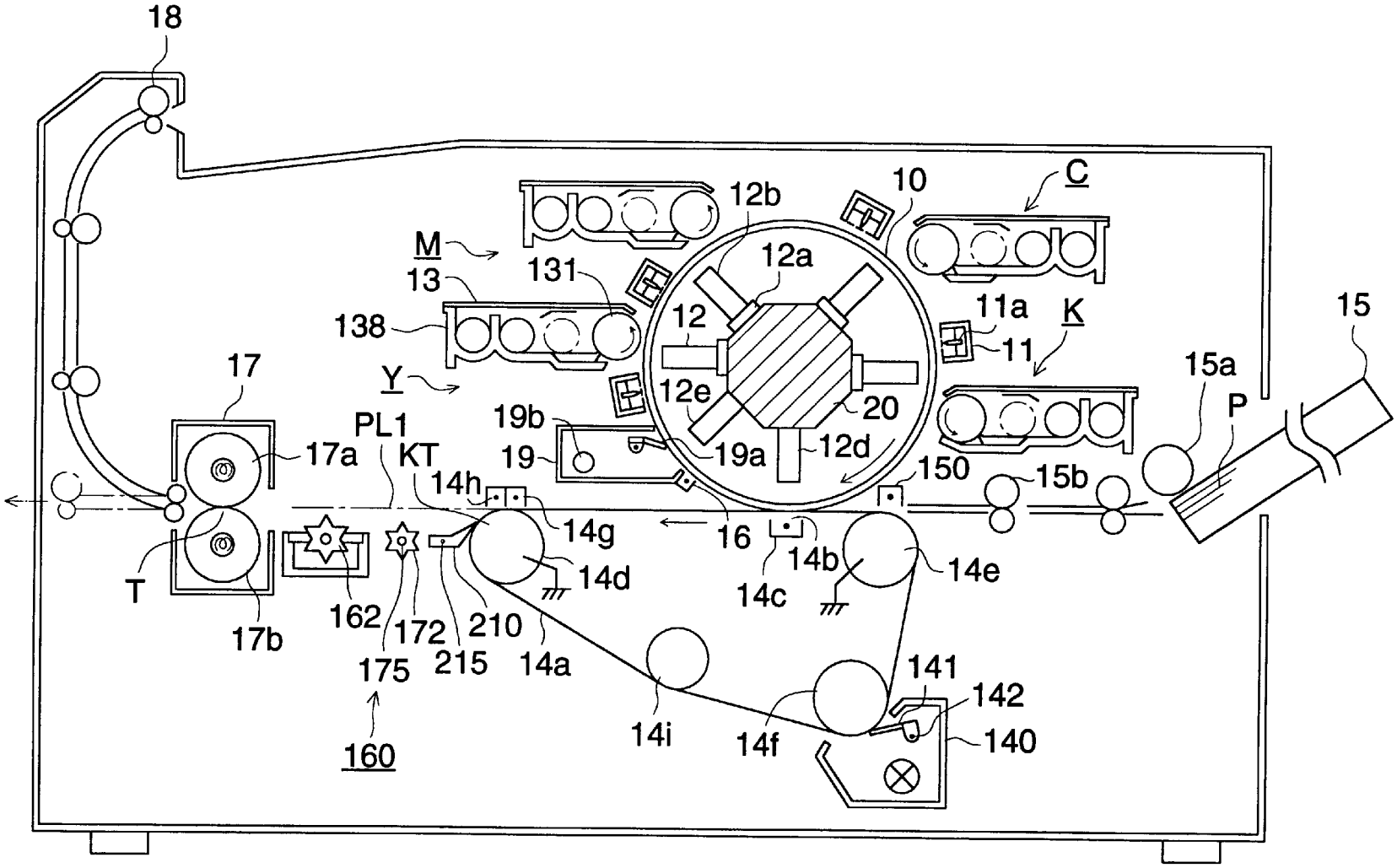
FIG. 9 is a sectional structural view of a color image forming apparatus showing another example of an image forming apparatus according to the present invention.
Figure 10:
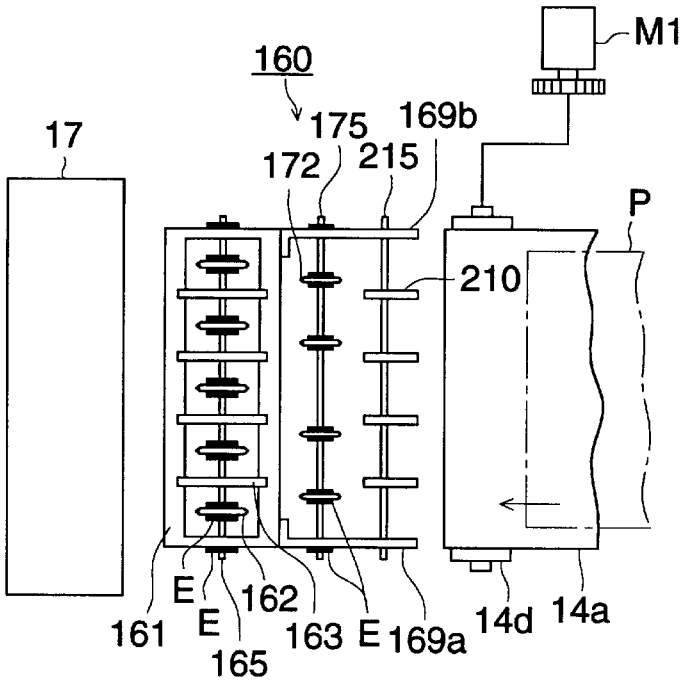
FIG. 10 is a view showing a claw member, a first spurred wheel member and a second spurred wheel member.
Figure 11:
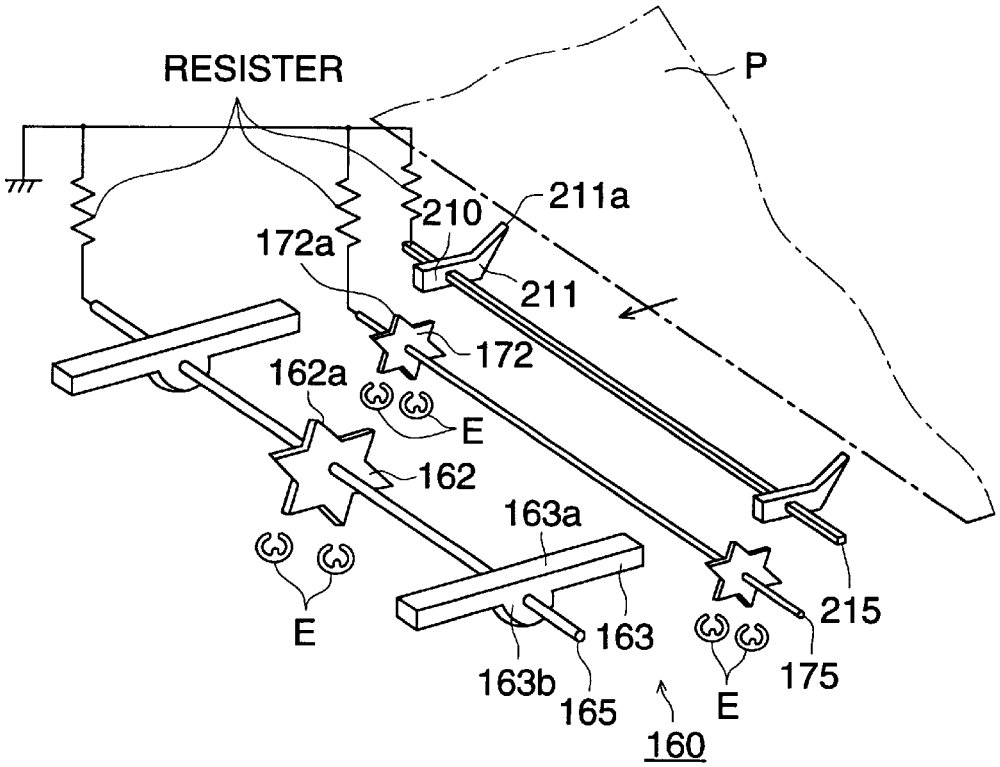
FIG. 11 is a perspective view of a main portion of FIG. 10.

Next, another example of the present invention will be described. Referring to FIG. 9 through FIG. 11, the image forming process and each mechanism of an example of the image forming apparatus common to the present invention will be described below. FIG. 9 is a sectional structural view of a color image forming apparatus showing an example of the image forming apparatus according to the present invention. FIG. 10 is a view showing a claw member, the first spurred wheel member and the second spurred wheel member, and FIG. 11 is a perspective view of a main portion of FIG. 10. Relating to FIG. 9, structures and operations different from those in FIG. 1 will be described below. In FIG. 9, the recording sheet P is separated from the toner image receiving body 14*a* at a curvature portion KT of an end portion of the toner image receiving body 14*a* trained around the driving roller 14*d* on the fixing device 17 side.

The conveying section 160 has the separating claw 210 which is the claw member, a front spurred wheel 172 which is the first spurred wheel member, and a back spurred wheel member 162 which is the second wheel member, and provided between the curvature portion KT of the end portion of the toner image receiving body 14*a* on the fixing device side and the fixing device 17. The conveying section 160 prevents the following: the toner image receiving body 14*a* is deformed by heat from the fixing device 17; the toner image borne on the toner image receiving body 14*a* is slightly fused and hardly transferred; or toner is fixedly adhered onto the toner image receiving body 14*a*.

The separating claw 210 which is the claw member, is provided in such a manner that the separating claw 210 is in close to the curvature portion KT of the toner image receiving body 14*a,* and is fixed on a support shaft 215 with a predetermined interval, preferably 0.1–2.0 mm, with respect to the toner image receiving body 14*a*. When the recording sheet P is separated from the toner image receiving body 14*a,* the separating claw 210 comes into contact with a leading edge portion of the recording sheet P which tends to be conveyed curving toward the toner image receiving body 14*a,* and helps the separation of the recording sheet P.

The front spurred wheel 172, which is the first spurred wheel member, is a spurred wheel member having a plurality of protrusions 172*a* (refer to FIG. 11) on the peripheral surface, and is rotatably provided around a rotational supporting shaft 175, on the downstream side of the conveyance direction of the recording sheet P in the vicinity of the separating claw 210. The front spurred wheel 172 picks the leading edge portion of the recording sheet P which is separated in contact with the separating claw 210, conveys the recording sheet P to the back spurred wheel 162 while guiding the back side of the recording sheet P, and prevents the back side toner image on the recording sheet P having toner images on both sides thereof, from being disturbed.

The back spurred wheel 162, which is the second spurred wheel member, is a spurred wheel member having a plurality of protrusions 162*a* (refer to FIG. 11) on the circumferential surfce thereof, and is rotatably provided around a rotational supporting shaft 165, on the downstream side in the conveyance direction of the recording sheet P with respect to the front spurred wheel 172. The back spurred wheel 162 guides the back side of the recording sheet P and conveys it, prevents the back side toner image on the recording sheet P having toner images on both sides thereof, from being disturbed, and stably conveys the recording sheet P to the fixing device 17 while making the entering direction into the fixing device 17 constant.

Next, referring to FIGS. 10, 11 and 9, the claw member, the first spurred wheel member and the second spurred wheel member, which are provided in the conveying section, will be described.

The driving roller 14*d* which is a roller member, is rotated by the rotation of the drive motor M1, the toner image receiving body 14*a* is rotated counterclockwise as shown by an arrow in FIG. 9 by the rotation of the driving roller 14*d,* and simultaneously with the rotation of the toner image receiving body 14*a,* the recording sheet P having toner images on both sides thereof is conveyed. The recording sheet P is separated from the toner image receiving body 14*a* at the curvature portion KT provided on the end portion of the toner image receiving body 14*a* on the fixing device 17 side, and is conveyed to the fixing device 17 through the conveying section 160. In the conveying section 160, a plurality of separating claws 210 which are claw members, the front spurred wheels 172 which are the first spurred wheel members, and the back spurred wheels 162 which are the second spurred wheel members are respectively arranged in parallel in the direction perpendicular to the conveyance direction of the recording sheet P, that is, in the direction of the length of the fixing device 17, in the order from the upstream side of the conveyance direction of the recording sheet P. The separating claw 210 is provided in close proximity to the curvature portion KT of the end portion of the toner image receiving body 14*a* on the fixing device 17 side, and these are respectively arranged as follows: the distance between the tip portion 211*a* of the separating claw 210 and the rotation center of the front spurred wheel 172 is about 5–30 mm, the distance between the rotation center of the front spurred wheel 172 and that of the back spurred wheel 162 is about 10–50 mm, and the distance between the rotation center of the back spurred wheel 162 and a position at which the transfer material enters into the fixing device 17 (hereinafter, called the entrance to the nip portion T) is about 20–60 mm.

The separating claw 210 is fixed at a predetermined position on, for example, a rectangular rod-like supporting shaft 215 by, for example, adhesive agent. The front spurred wheel 172, in the rotation center of which the rotation supporting shaft 175 is inserted, is rotatbly attached at a predetermined position on the rotation supporting shaft 175 by the E-ring E. The supporting shaft 215 and the rotation supporting shaft 175 are respectively fixed in holders 169*a* and 169*b* of both ends, which are provided on the upstream side in the conveyance direction of the recording sheet P, of the conveying section casing 161, and a plurality of separating claws 210 and front spurred wheels 172 are respectively arranged in parallel in the direction perpendicular to the conveyance direction of the recording sheet P, that is, in the lengthwise direction of the fixing device 17.

Both ends of the back spurred wheel 162 through the central hole of which the rotation supporting shaft 165 formed of, for example, a metallic rod is inserted, are rotatably fastened by the E-rings E at a predetermined position on the rotation supporting shaft 165. The rotation supporting shaft 165 is inserted into a hole of a semicircular stopping portion 163*b* provided at an opposite side of a guiding surface 163*a* of a conveyance guiding member 163, a plurality of conveyance guiding members 163 are set in predetermined positions of the conveying section casing 161 in parallel to the conveyance direction of the recording sheet P, both ends of the rotation supporting shaft 165 are fastened by the E-rings E and fixed in the conveying section casing 161, and thus, the conveying section 160 is structured.

For the separating claw 210, a resin molding member formed of, for example, Teflon, polyimide, polycarbonate resin, etc., is used, and the separating claw 210 is provided with the claw portion 211. The tip portion 211*a* of the claw portion 211 is arranged with a predetermined interval of, for example, 0.1–2.0 mm to the toner image receiving body 14*a,* and the leading edge portion of the recording sheet P is separated by the tip portion 211*a*.

As the front spurred wheel 172, a spurred wheel of 0.05–0.5 mm thick and 3–20 mm outer diameter in which a metallic plate such as a stainless plate, copper plate, or the like, is etching processed, or a spurred wheel formed of a resin member of 0.5–2.0 mm thick and 3–20 mm outer diameter is used, and the front spurred wheel 172 is formed of a polygonal, for example, hexagonal plate-like member provided with a plurality of sharp protrusions 172*a* on the tips thereof.

As the back spurred wheel 162, a spurred wheel of 0.05–0.5 mm thick and 5–30 mm outer diameter in which a metallic plate such as a stainless plate, copper plate, or the like, is etching processed, or a spurred wheel formed of a resin member of 0.5–2.0 mm thick and 5–30 mm outer diameter is used, and the back spurred wheel 162 is formed of a polygonal, for example, hexagonal plate-like member provided with a plurality of sharp protrusions 162*a* on the tips thereof.

The leading edge portion of the recording sheet P separated by the separating claw 210 is picked up by the front spurred wheel 172, and the recording sheet P is sent to the front spurred wheel 172. The front spurred wheel 172 is rotated under the condition that the protrusion 172*a* of the front spurred wheel 172 is in contact with or sticks the recording sheet P, the toner image is not rubbed, and the recording sheet P is conveyed to the back spurred wheel 162 while the entering direction into the fixing device 17 is being made constant.

The back spurred wheel 162 guides the back side of the recording sheet P and conveys the recording sheet P, and prevents the back side toner image of the recording sheet P having the toner image on the back side thereof from being disturbed, and the recording sheet P is conveyed to the fixing device 17 while the entering direction into the fixing device 17 is being made constant.

As described above, although the advancing direction of the leading edge portion of the recording sheet P is unstable after being brought into contact with the separating claw 210, the advancing direction of the leading edge portion of the recording sheet P can be made almost constant when 2 rows of spurred wheel members are provided as the first and second spurred wheel members. That is, the functions of respective spurred wheel members are different from each other as follows: the front spurred wheel 172 which is the first spurred wheel member of the first row, picks up the leading edge portion of the recording sheet P, and the second spurred wheel member of the second row determines the advancing direction of the leading edge portion of the recording sheet P and guides the back side of the recording sheet P.

When the above-described separating claw 210, the front spurred wheel 172 or back spurred wheel 162 are formed of the metallic plate, it is preferable that these members are electrically grounded through high resistance members of $10^8$–$10^{14}\Omega$, through the supporting shaft 215, rotation supporting shafts 175 and 176 formed of metallic members. When the separating claw 210, the front spurred wheel 172 or back spurred wheel 162 are electrically grounded through high resistance members, toner adhesion onto the separating claw 210, the front spurred wheel 172 or back spurred wheel 162 due to the electric charge accumulation or the mirror image force can be prevented, and the toner image can be prevented from being disturbed. Further, the separating claw 210, the front spurred wheel 172 and back spurred wheel 162 which are formed of a metallic plate, are made to be in an electrically floating condition, or voltage with the same polarity as the toner (in the present example, the negative polarity) is applied to these metallic plates, thereby, toner adhering can be prevented and the toner image can be prevented from being disturbed. Other than that, when insulating members such as insulating resin members are used for the separating claw 210, the front spurred wheel 172 and back spurred wheel 162, in the same manner as in the above-described floating, toner adhering due to electrical charge accumulation or the mirror image force can be prevented, and the toner image can be prevented from being disturbed. Either of the following methods is preferable in which both of the claw member and spurred wheel members are in the electrically floating condition, or electrically grounded through high resistance members.

The guiding surface 163*a* of the conveyance guiding member 163 is provided on the transfer material conveyance surfce side (upper side) higher than the rotation center of the back spurred wheel 162. Thereby, even when the leading edge of the recording sheet P which is separated from the toner image receiving body 14*a* by the separating claw 210 and conveyed to the back spurred wheel 162 through the front spurred wheel 172, comes into contact with the guiding surface 163*a,* the leading edge of the recording sheet P is picked up by the guiding surface 163*a* and is sent to the back spurred wheel 162, and the back spurred wheel 162 is rotated under the condition that the protrusion 162*a* of the back spurred wheel 162 is in contact with or sticks the recording sheet P, thereby, the recording sheet P is conveyed to the fixing device 17 without toner image being rubbed.

When the recording sheet P conveyed by the toner image receiving body 14*a* is separated from the toner image receiving body 14*a* at the curvature portion KT of the end portion of the toner image receiving body 14*a,* a radius of curvature of the driving roller 14*d* constituting the curvature portion KT of the end portion of the toner image receiving body 14*a* is preferably not more than 15 mm, and more preferably not more than 10 mm. When the radius of curvature is not more than 15 mm, and a paper separation AC discharger 14*h* which is a transfer material separating means, is provided opposing to the end portion of the toner image receiving body 14*a* as in the present example, separation of the recording sheet P can be stably carried out by the curvature of the toner image receiving body 14*a,* the discharging operation by the paper separation AC discharger 14*h* and the separating claw 210 as an auxiliary separating means, and the recording sheet P can be stably moved to the conveying section 160. When the radius of curvature is not more than 10 mm, it is not necessary to provide the paper separation AC discharger 14*h,* and the separation of the recording sheet P from the toner image receiving body 14*a* can be stably carried out by the curvature of the end portion of the toner image receiving body 14*a* and the separating claw 210, and the recording sheet P can also be stably moved to the conveying section 160.

Figure 12:
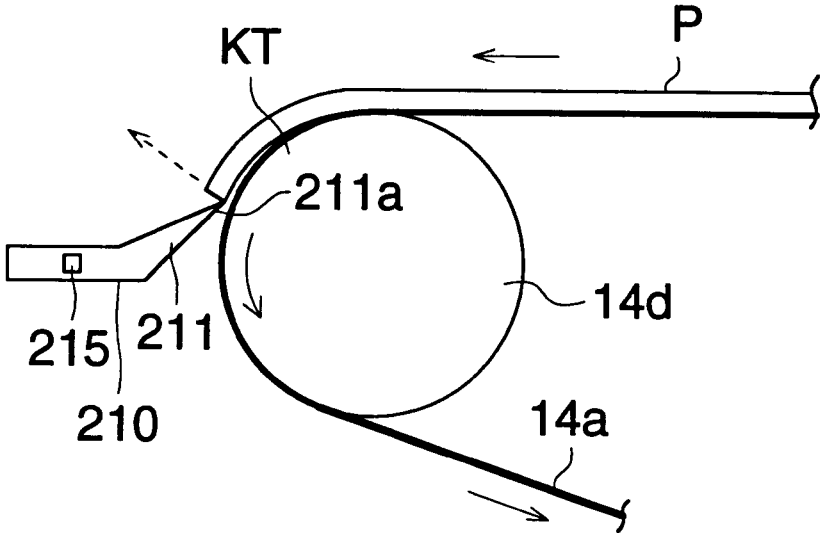
FIG. 12 is a view showing a separating condition of a transfer material, conveyed by the second image bearing means, by the claw member.
Figure 13:
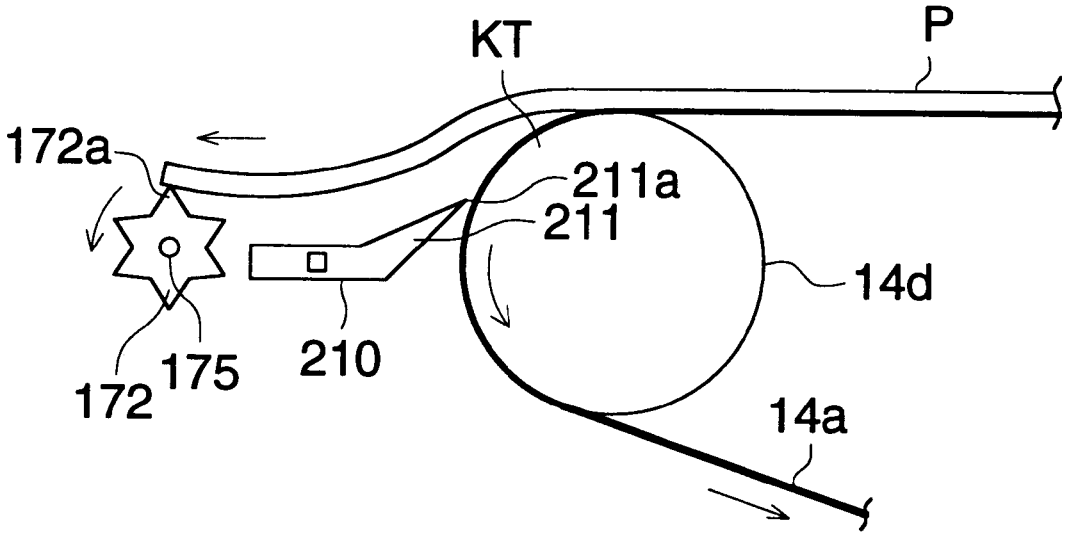
FIG. 13 is a view showing a passing condition of the transfer material over the first spurred wheel member after separation by the claw member.
Figure 14:
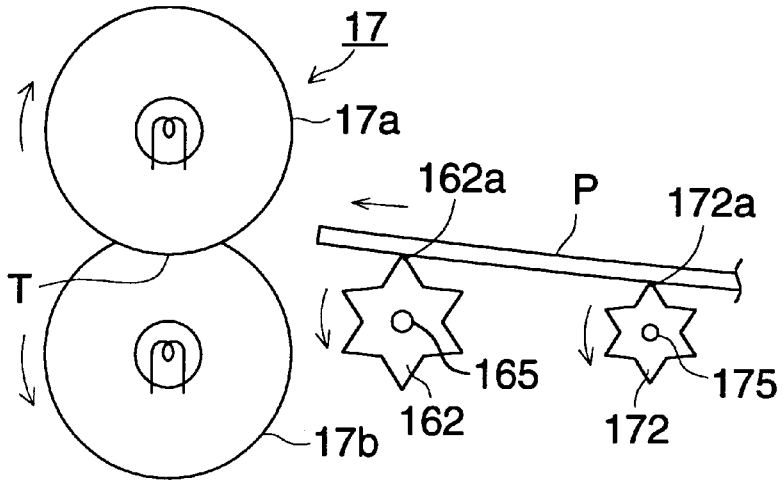
FIG. 14 is a view showing a passing condition of the transfer material over the first spurred wheel member and the second spurred wheel member.

Referring to FIGS. 12–14, and 9, the first structure according to the present example will be described below. FIG. 12 is a view showing a separating condition of the transfer material conveyed by the second image bearing means by the claw member. FIG. 13 is a view showing a passing condition of the transfer material over the first spurred wheel member after the separation by the claw member. FIG. 14 is a view showing a passing condition of the transfer material over the first spurred wheel member and the second spurred wheel member.

The recording sheet P on both sides of which color toner images are formed, is separated from the toner image receiving body 14*a* by the curvature of the curvature portion KT of the toner image receiving body 14*a,* the discharging operation of the paper separation AC discharger 14*h* as the transfer material separating means, provided at need at the end portion of the toner image receiving body 14*a,* and the separating claw 210 provided with a predetermined interval to the toner image receiving body 14*a,* conveyed to the fixing device 17 as the fixing means, through the front spurred wheel 172 and the back spurred wheel 162, and the toner image on the recording sheet P is fixed by heat and pressure which are applied thereon at the nip portion T between the fixing roller 17*a* and the pressure-contact roller 17*b*.

As shown in FIG. 12, the leading edge portion of the recording sheet P conveyed onto the curvature portion KT of the toner image receiving body 14*a* trained around the driving roller 14*d* is brought into contact with the tip portion 211*a* of the separating claw 210 fixed by the supporting shaft 215 with a predetermined interval to the toner image receiving body 14*a,* and is flipped up in the direction of a dotted line arrow with a momentum as the leading edge portion of the recording sheet P is hitched by the tip portion 211*a* of the separating claw 210.

Succeedingly, as shown in FIG. 13, the leading edge portion of the recording sheet P separated from the curvature portion KT of the toner image receiving body 14*a* is picked up by the protrusion 172*a* of the front spurred wheel 172 which is arranged in close to the separating claw 210 and rotatably provided on the rotation supporting shaft 175. After the leading edge portion of the recording sheet P has been picked up, the recording sheet P is conveyed in such a manner that the back side of the recording sheet P is not in contact with the separating claw 210.

Following to that, as shown in FIG. 14, the recording sheet P sent by the front spurred wheel 172 is conveyed to the back spurred wheel 162 rotatably provided on the rotation supporting shaft 165, the recording sheet p is conveyed while the back side of the recording sheet P is being guided by the protrusion 172*a* of the front spurred wheel 172 and the protrusion 162*a* of the back spurred wheel 162, and the recording sheet P enters into the nip portion T between the fixing roller 17*a* and the pressure-contact roller 17*b* of the fixing device 17 after the advancing direction toward the fixing device 17 is made to be almost constant.

According to the foregoing, the recording sheet p can be finely separated from the toner image receiving body 14*a,* and can stably be conveyed to the fixing device 17 while the back side toner image of the recording sheet P having the toner images on both sides thereof is prevented from being disturbed.

In the foregoing, when the spurred wheel member is only one, the advancing direction of the leading edge portion of the recording sheet P is dispersed, and it causes disturbance of the back side toner image or fixing wrinkling, depending on a flipped-up condition of the recording sheet P at the time of separation by the separating claw 210.

Figure 15:
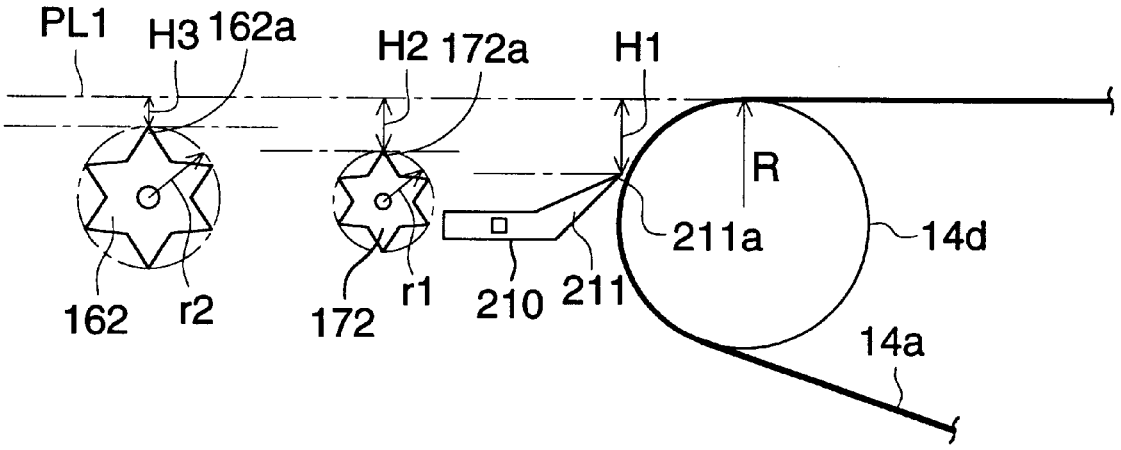
FIG. 15 is a view showing the positional relationship of the claw member, the first spurred wheel member and the second spurred wheel member with respect to the transfer material conveyance surface of the second image bearing means, and radiuses of curvature of the first and second spurred wheel members.
Figure 16:
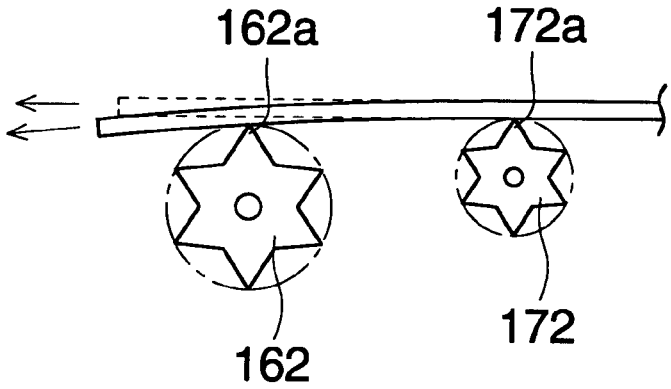
FIG. 16 is a view showing an unpreferable example of positions of the first and the second spurred wheel members of FIG. 15.
Figure 17:
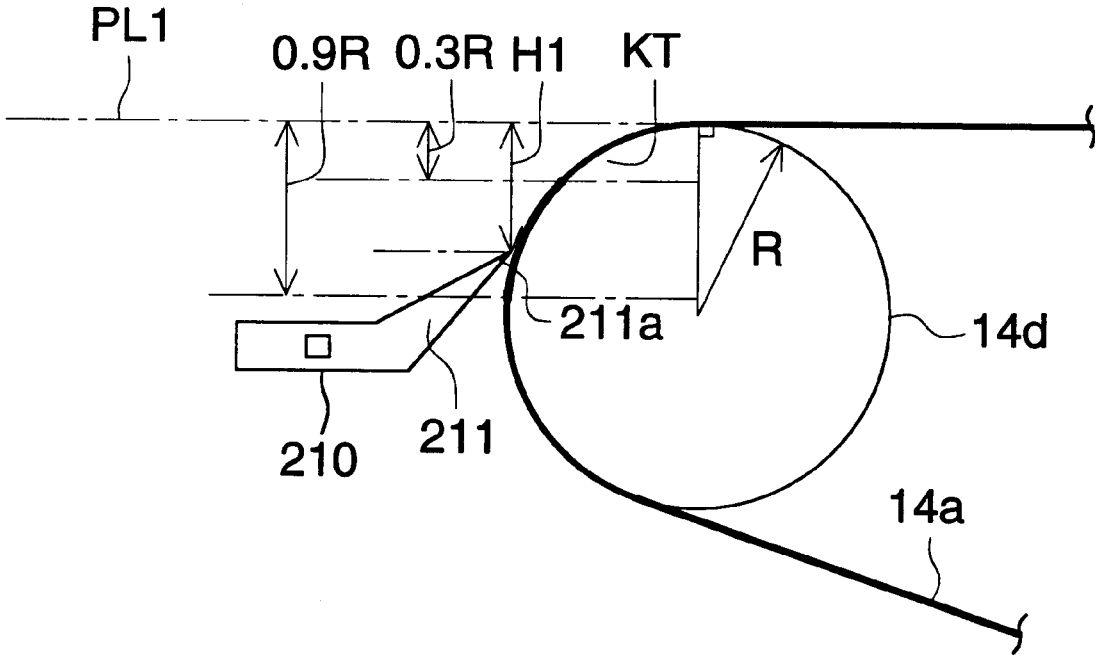
FIG. 17 is a view showing an optimum position of the claw member with respect to a curvature portion of the second image bearing means.

Referring to FIGS. 15 to 17, the second structure according to the present example will be described bellow. FIG. 15 is a view showing the positional relationship of the claw member, the first spurred wheel member, and the second spurred wheel member with respect to the transfer material conveying surface of the second image bearing means, and radiuses of curvature of the first and second spurred wheel members. FIG. 16 is a view showing an unpreferable example of positions of the first and second spurred wheel members in FIG. 15. FIG. 17 is a view showing an optimum position of the claw member with respect to the curvature portion of the second image bearing means.

The recording sheet P on both sides of which color toner images are formed, is separated from the toner image receiving body 14*a* by the curvature of the curvature portion KT of the toner image receiving body 14*a,* the discharging operation of the paper separation AC discharger 14*h* as the transfer material separating means, provided at need at the end portion of the toner image receiving body 14*a,* and the separating claw 210 provided with a predetermined interval to the toner image receiving body 14*a,* conveyed to the fixing device 17 as the fixing means, through the front spurred wheel 172 and the back spurred wheel 162, and the toner image on the recording sheet P is fixed by heat and pressure which are applied thereon at the nip portion T between the fixing roller 17*a* and the pressure-contact roller 17*b*.

As shown in FIG. 15, when a minimum distance between the conveyance surface of the recording sheet P conveyed by the toner image receiving body 14*a,* or an extension surface thereof (hereinafter, called the transfer material conveyance surface PL1) and the separating claw 210 is H1 (mm), a minimum distance between the transfer material conveyance surface PL1 and the first spurred wheel member is H2 (mm), and a minimum distance between the transfer material conveyance surface PL1 and the second spurred wheel member is H3 (mm), the following relationship is necessary: $H3 \leqq H2 < H1$. Thereby, thee back side of the recording sheet P is not rubbed by the separating claw 210, the advancing direction of the leading edge portion of the recording sheet P is made almost constant, and entering of the recording sheet P into the fixing device 17 becomes stable.

When $H2 > H1$, the back side of the recording sheet P is rubbed by the separating claw 210 and thereby, disturbance of the back side toner image occurs. When $H3 \geqq H2$, as shown in FIG. 16, the advancing direction of the leading edge portion of the recording sheet P can not be determined by the back spurred wheel 162, thereby, the entering direction into the fixing device 17 is dispersed, and it causes disturbance of the back side toner image or fixing wrinkling.

Further, it is preferable that the radius of curvature R at the curvature portion KT of the toner image receiving body 14*a* which is formed by being trained around the driving roller 14*d* as shown in FIG. 17 is not more than 15 mm, and it is more preferable that the radius of curvature R is not more than 10 mm as described above. When the radius of curvature R exceeds 15 mm, the curvature separation is hardly conducted when the environmental condition changes (when temperature is lower than 25° C., and humidity is lower than 40%) or thin paper is used as the recording sheet P, therefore, the paper separation AC discharger 14*h* is necessary. Normally, when the radius of curvature R is not more than 15 mm, it is not necessary to provide the paper separation AC discharger 14*h,* and when the environmental condition changes or thin paper is used as the recording sheet P, it is not necessary to provide the paper separation AC discharger 14*h,* when the radius of curvature R is not more than 10 mm.

Further, it is preferable that, with respect to the radius of curvature R at the curvature portion KT of the toner image receiving body 14*a,* the minimum distance H1 between the transfer material conveyance surface PL1 and the tip portion 211*a* of the separating claw 210 is $0.3 \leqq H1 \leqq 0.9 \times R$. That is, it is preferable that the tip portion 211*a* of the separating claw 210 is located within positions shown by a bold line in FIG. 17. When $0.3 \times R > H1$, sometimes, the back side of the recording sheet P is rubbed by the separating claw 210. When $H1 > 0.9 \times R$, sometimes, the leading edge portion of the recording sheet P is caught by the tip portion 211*a* of the separating claw 210, or the leading edge portion of the recording sheet P is bent.

Figure 18:
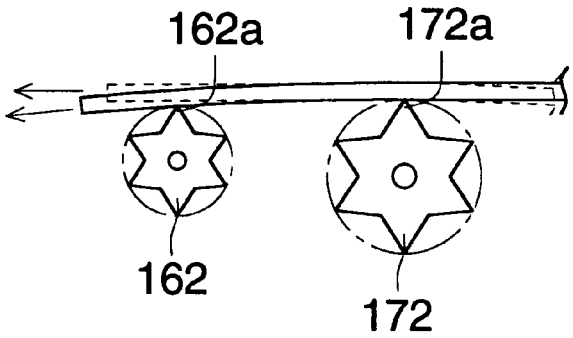
FIG. 18 is a view showing an unpreferable example of radiuses of curvature of the first and the second spurred wheel members of FIG. 15.

Referring to the above-described FIG. 15 and FIG. 18, the third structure according to the present example will be described below. FIG. 18 is a view showing an unpreferable example of radiuses of curvature of the first and second spurred wheel members.

The recording sheet P on both sides of which color toner images are formed, is separated from the toner image receiving body 14*a* by the curvature of the curvature portion KT of the toner image receiving body 14*a,* the discharging operation of the paper separation AC discharger 14*h* as the transfer material separating means, provided at need at the end portion of the toner image receiving body 14*a,* and the separating claw 210 provided with a predetermined interval to the toner image receiving body 14*a,* conveyed to the fixing device 17 as the fixing means, through the front spurred wheel 172 and the back spurred wheel 162, and the toner image on the recording sheet P is fixed by heat and pressure which are applied thereon at the nip portion T between the fixing roller 17*a* and the pressure-contact roller 17*b*.

As shown in FIG. 15, when the radius of curvature of a circle (circumferential surface) formed of protrusions 172*a* of the front spurred wheel 172 is r1 (mm), and the radius of curvature of a circle (circumferential surface) formed of protrusions 162*a* of the back spurred wheel 162 is r2 (mm), the relationship of $r1 < r2$ is necessary. That is, a diameter of the spurred wheel member on the upstream side in the conveyance direction of the recording sheet P is made smaller than that of the spurred wheel member on the downstream side. Ordinarily r1 is about 1–10 mm, preferably 2–5 mm, and r2 is ordinarily 3–20 mm, preferably 5–10 mm. When the leading edge portion of the recording sheet P flipped up by the separating claw 210 is picked up by the front spurred wheel 172 of the smaller diameter, dispersion of the advancing direction of the recording sheet P after the recording sheet P passes the front spurred wheel 172, can be made smaller.

When $r1 \geqq r2$, that is, when the leading edge portion of the recording sheet P flipped up by the separating claw 210 is picked up by the front spurred wheel of the larger diameter, the leading edge portion is easily caught by the front spurred wheel 172, and further, because the leading edge portion of the recording sheet P is held by the back spurred wheel 162 with the smaller diameter after passing the front spurred wheel 172 with the larger diameter, the advancing direction of the recording sheet P is easily influenced by the vertical movement of the front spurred wheel 172 with the larger diameter on the front side, thereby the entering direction of the leading edge portion of the recording sheet P into the fixing device 17 is dispersed.

Figure 19:
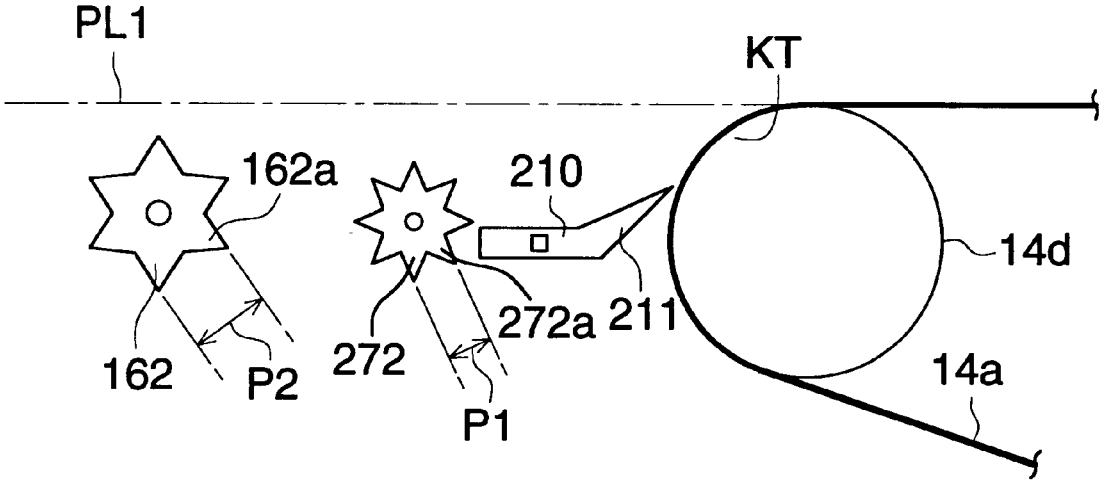
FIG. 19 is a view showing a distance (pitch) between protrusions of the first spurred wheel member and that of the second spurred wheel member.

Referring to FIG. 19, the fourth structure according to the present example will be described below. FIG. 19 is a view showing an interval (pitch) of protrusions of the first spurred wheel member and the second spurred wheel member.

The recording sheet P on both sides of which color toner images are formed, is separated from the toner image receiving body 14*a* by the curvature of the curvature portion KT of the toner image receiving body 14*a,* the discharging operation of the paper separation AC discharger 14*h* as the transfer material separating means, provided at need at the end portion of the toner image receiving body 14*a,* and the separating claw 210 provided with a predetermined interval to the toner image receiving body 14*a,* conveyed to the fixing device 17 as the fixing means, through the front spurred wheel 172 and the back spurred wheel 162, and the toner image on the recording sheet P is fixed by heat and pressure which are applied thereon at the nip portion T between the fixing roller 17*a* and the pressure-contact roller 17*b*.

In the present example, as shown in FIG. 19, an octagonally formed front spurred wheel is provided as the first spurred wheel member instead of the above-described hexagonally formed front spurred wheel 172, and when an interval (pitch) between adjoining protrusions 272*a* of the front spurred wheel 272 is P1 (mm), and an interval (pitch) between adjoining protrusions 162*a* of the back spurred wheel 162 is P2 (mm), the relationship of P1<P2 is necessary. That is, the pitch of the spurred wheel member on the upstream side in the conveyance direction of the recording sheet P is smaller than that of the spurred wheel member on the downstream side. The pitch P1 is ordinarily about 0.5–5 mm, preferably 1–3 mm, and P2 is ordinarily about 2–10 mm, preferably 3–7 mm. When the leading edge portion of the recording sheet P flipped up by the separating claw 210 is picked up by protrusions 272*a* of the front spurred wheel 272 which is the first spurred wheel member with the smaller pitch, the vertical movement of the recording sheet P during passage of the recording sheet P on the front spurred wheel 272 is made smaller, and dispersion of the advancing direction of the recording sheet P after the recording sheet P passes the front spurred wheel 272, can be made smaller. Further, the vertical movement at the position of the front spurred wheel 272 is smaller, thereby the back side of the recording sheet P is not rubbed with the separating claw 210.

When P1≧P2, the vertical movement of the recording sheet P at the time of passage of the recording sheet P on the front spurred wheel 272, is larger, thereby the back side of the recording sheet P is rubbed with the separating claw 210. Further, the advancing direction of the recording sheet P after the recording sheet P passes the front spurred wheel 272, is dispersed, and the recording sheet P is held by the protrusion 162*a* of the back spurred wheel 162 which is the second spurred wheel member with the smaller pitch, thereby, the advancing direction of the recording sheet P is largely influenced by the vertical movement of the front spurred wheel 272, and finally, the entering direction of the recording sheet P into the fixing device 17 is dispersed.

Figure 20:
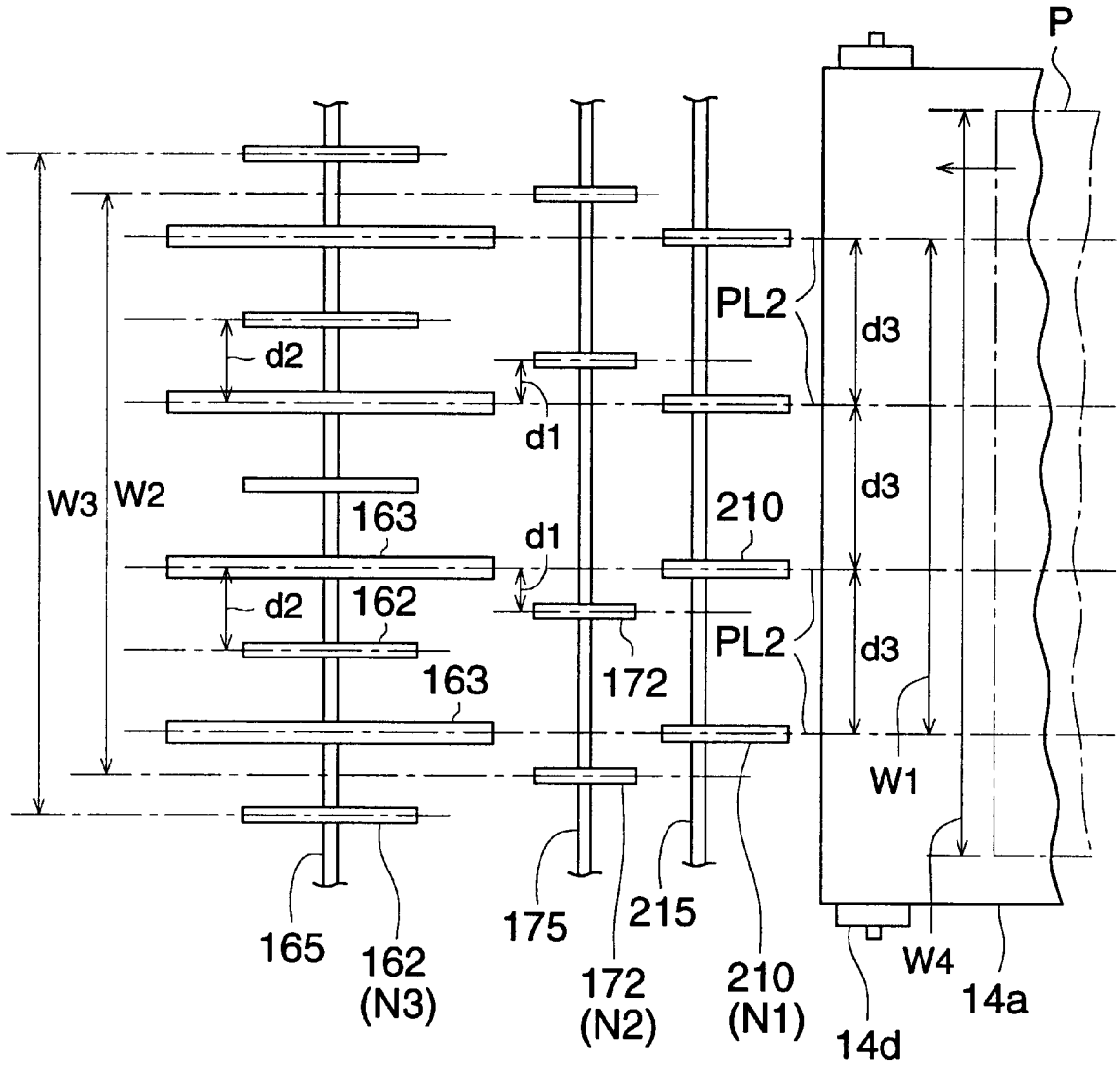
FIG. 20 is a view showing the positional relationship of the claw members, the first spurred wheel members, the second spurred wheel members, and the conveyance guiding member and respective numbers.
Figure 21:
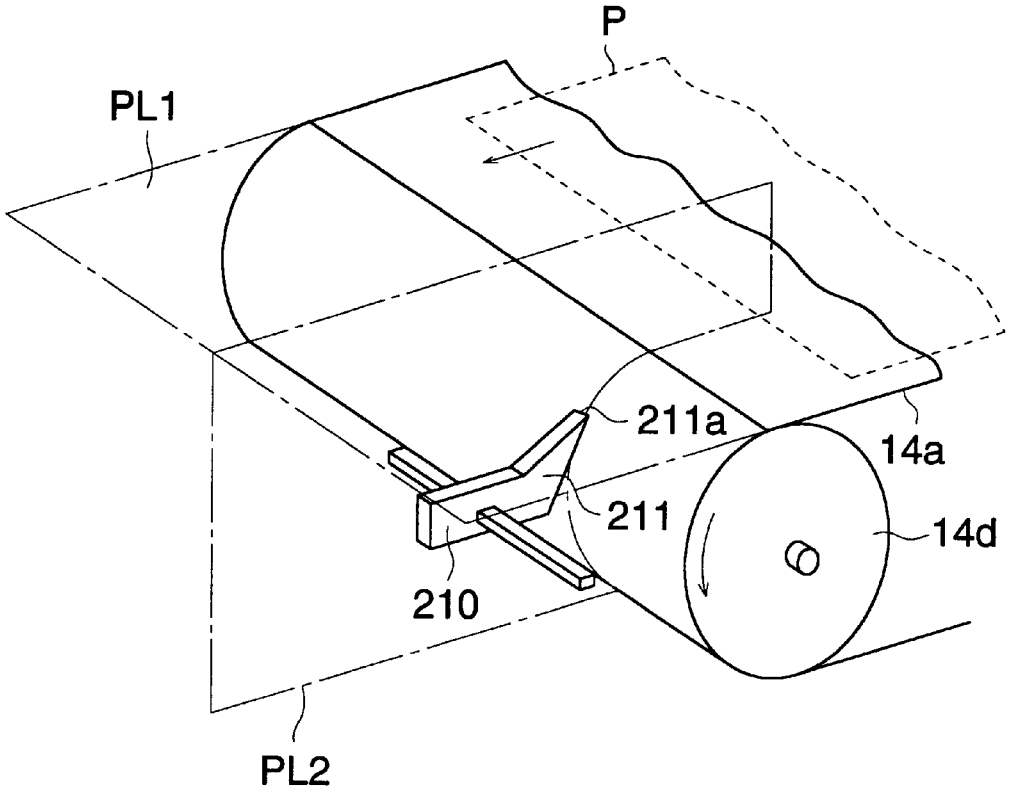
FIG. 21 is a perspective view showing an imaginary sectional view of FIG. 20.
Figure 22:
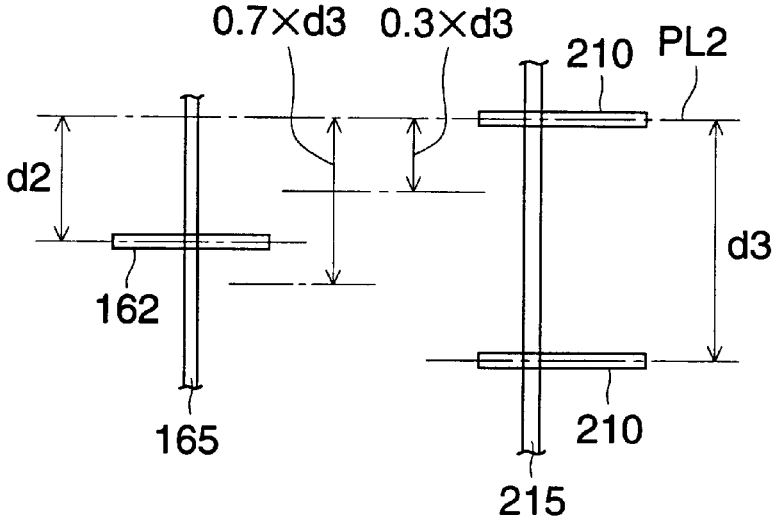
FIG. 22 is a view showing a preferable arrangement of the second spurred wheel member of FIG. 20.
Figure 23:
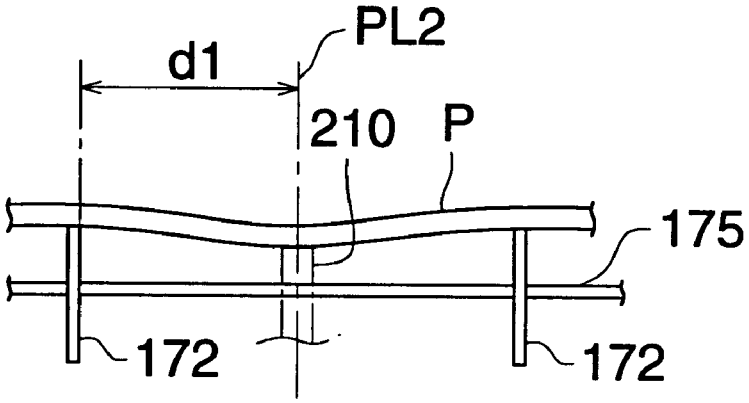
FIG. 23 is a view showing an unpreferable example of a distance between the first spurred wheel member and the claw member of FIG. 20.

Referring to FIGS. 20 to 23, the fifth structure according to the present example will be described below. FIG. 20 shows the positional relationship of the claw member, the first spurred wheel member, second spurred wheel member and conveyance guiding member, and respective number thereof. FIG. 21 is a perspective view showing an imaginary sectional view of FIG. 20. FIG. 22 is view showing a preferable position of the second spurred wheel member in FIG. 20, and FIG. 23 is a view showing an unpreferable distance between the first spurred wheel member and the claw member.

The recording sheet P on both sides of which color toner images are formed, is separated from the toner image receiving body 14*a* by the curvature of the curvature portion KT of the toner image receiving body 14*a,* the discharging operation of the paper separation AC discharger 14*h* as the transfer material separating means, provided at need at the end portion of the toner image receiving body 14*a,* and the separating claw 210 provided with a predetermined interval to the toner image receiving body 14*a,* conveyed to the fixing device 17 as the fixing means, through the front spurred wheel 172 and the back spurred wheel 162, and the toner image on the recording sheet P is fixed by heat and pressure which are applied thereon at the nip portion T between the fixing roller 17*a* and the pressure-contact roller 17*b*.

As shown in FIGS. 20 and 21, when the closest distance between a imaginary transverse section PL2 (hereinafter, referred to as the virtual transverse section PL2) which is perpendicular to the transfer material conveyance surface PL1 of the recording sheet P conveyed by the toner image receiving body 14*a* and crosses the central portion of the separating claw 210 in the conveyance direction of the recording sheet P, and the circumferential surface of the front spurred wheel 172 which is the first spurred wheel member closest to the imaginary transverse section Pl2, is d1 (mm), and the closest distance between the virtual transverse section PL2 and the circumferential surface of the back spurred wheel 162 which is the second spurred wheel member closest to the imaginary transverse section PL2, is d2 (mm), the relationship d1<d2 is necessary. That is, the front spurred wheel 172 is provided near the separating claw 210, and the back spurred wheel 162 is provided separated from the separating claw 210, with respect to the direction perpendicular to the conveyance direction of the recording sheet P. The distance d1 is normally about 0–10 mm, preferably not more than 5 mm, and the distance d2 is normally about 50–150 mm. It is necessary for the position of the back spurred wheel 162 that, as shown in FIG. 22, when the interval between the separating claw 210 which is crossed by the virtual transverse section PL2, and the adjoining separating claw 210 with the back spurred wheel 162, which is closest to the imaginary transverse section PL2, between them, is d3 (mm), the following relationship is preferable so that the back spurred wheel 162 positions near the center of adjoining separating claws, 0.3×d3≦d2≦0.7×d3. It is more preferable that the back spurred wheel 162 is provided in the vicinity of the intermediate position (d2=0.5×d3) of the adjoining separating claws 210. Because the leading edge portion of the recording sheet P flipped up by the separating claw 210 is picked up by the front spurred wheel 172 provided near the separating claw 210, the back side of the recording sheet P is not rubbed with the separating claw 210. Further, the back side of the recording sheet P which is going to hang down toward the back side between adjoining separating claws 210 is guided by the back spurred wheel 162 provided separated from the separating claw 210 and the recording sheet P is made to enter into the fixing device 17, thereby, fixing wrinkling does not occur.

When d1 is larger and the front spurred wheel 172 is provided separated from the separating claw 210, as shown in FIG. 23, because the recording sheet P hangs down toward the back side thereof between adjoining front spurred wheels 172, the hanging down portion of the recording sheet P is rubbed with the separating claw 210. Further, it is difficult to catch at the leading edge portion of the recording sheet P flipped up by the separating claw 210. When d2 is smaller and the back spurred wheel 162 is provided near the virtual transverse section PL2, the central portion of the recording sheet P hangs down toward the back side of the recording sheet p between adjoining separating claws 210, and the recording sheet P enters into the fixing device 17 under that condition, thereby, fixing wrinkling easily occurs.

Figure 24:
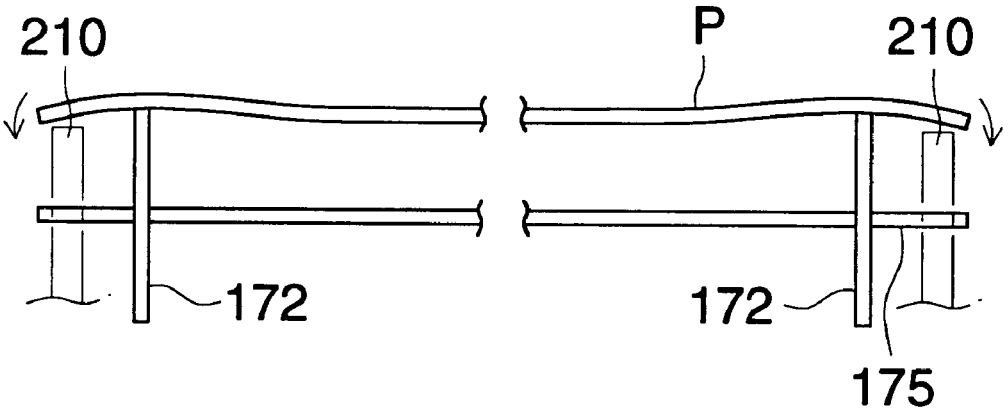
FIG. 24 is a view showing an unprefrable example of the arrangement of the claw member and the first spurred wheel member which are arranged with the maximum distance between them.

Referring to FIG. 20 and FIG. 24, the sixth structure according to the present example, will be described below. FIG. 24 is a view showing an unpreferable example of the arrangement of the claw members which are provided most separated from each other and the fist spurred wheel members.

The recording sheet P on both sides of which color toner images are formed, is separated from the toner image receiving body 14*a* by the curvature of the curvature portion KT of the toner image receiving body 14*a,* the discharging operation of the paper separation AC discharger 14*h* as the transfer material separating means, provided at need at the end portion of the toner image receiving body 14*a,* and the separating claw 210 provided with a predetermined interval to the toner image receiving body 14*a,* conveyed to the fixing device 17 as the fixing means, through the front spurred wheel 172 and the back spurred wheel 162, and the toner image on the recording sheet P is fixed by heat and pressure which are applied thereon at the nip portion T between the fixing roller 17*a* and the pressure-contact roller 17*b*.

As shown in FIG. 20, when the distance between separating claws 210 which are most separately provided from each other is W1 (mm), the distance between front spurred wheels 172 which are most separately provided from each other is W2 (mm), and the distance between back spurred wheels 162 which are most separately provided from each other is W3 (mm), the relationship $W1 \leqq W2 < W3$ is necessary. That is, the width of members on the downstream side in the conveyance direction of the recording sheet P in respective members is arranged so as to be larger than that of members on the upstream side. According to the foregoing, even when both sides of the recording sheet P hang down toward the back side thereof, that portion can be prevented from being rubbed with the separating claw 210, and thereby, the recording sheet P can be prevented from fixing wrinkling being generated thereon.

When $W1 > W2$, as shown in FIG. 14, both side end portions of the recording sheet P hang down toward the back side thereof on both sides (outsides) of the front spurred wheels 172, and those portions are rubbed with the separation claws 210. Further, when $W2 \geqq W3$, both side end portions of the recording sheet P hang down toward the back side thereof on both sides (outsides) of the back spurred wheels 162 and the recording sheet P enters into the fixing device 17 under that condition, thereby, fixing wrinkling is generated on both side ends thereof.

Further, it is preferable that, when the maximum width of the recording sheet P in the direction perpendicular to the conveyance direction of the recording sheet P is w4 (mm), the distance W3 (mm) between back spurred wheels 162 which are most separated from each other, has the relationship of $0.8 \times w4 \leqq W3 \leqq 0.95 \times W4$. When $0.8 \times w4 > W3$, both sides ends of the recording sheet P easily hang down, and fixing wrinkling easily occurs. When $W3 > 0.95 \times W4$, in the case where conveyance of the recording sheet P is shifted toward this side (or the further side), the end portion of the recording sheet P is not caught on the back spurred wheel 162 located at the most side end.

Referring to FIG. 20, the seventh structure according to the present example will be described below.

The recording sheet P on both sides of which color toner images are formed, is separated from the toner image receiving body 14*a* by the curvature of the curvature portion KT of the toner image receiving body 14*a,* the discharging operation of the paper separation AC discharger 14*h* as the transfer material separating means, provided at need at the end portion of the toner image receiving body 14*a,* and the separating claw 210 provided with a predetermined interval to the toner image receiving body 14*a,* conveyed to the fixing device 17 as the fixing means, through the front spurred wheel 172 and the back spurred wheel 162, and the toner image on the recording sheet P is fixed by heat and pressure which are applied thereon at the nip portion T between the fixing roller 17*a* and the pressure-contact roller 17*b*.

As shown in FIG. 20, when the number of separating claws 210 is N1, the number of front spurred wheels 172 is N2, and the number of back spurred wheels 162 is N3, the following relationships are necessary: $N1 \leqq N2$, and $N1+1 \leqq N3$. That is, in order to catch at the leading edge portion of the recording sheet P flipped up by the separating claw 210, the same number or more than the same number of front spurred wheels 172 as the number of separating claws 210 are provided near the separating claws 210, and back spurred wheels 162 whose number is larger than the number of separating claws 210 by more than 1, are provided so that these spurred wheels 162 are arranged at respective intermediate positions between respective adjoining separating claws 210 and at the outside of these separating claws 210. According to the foregoing, when the leading edge portion of the recording sheet P flipped up by the separating claws 210 is picked up by the front spurred wheels 172, the back side of the recording sheet P is not rubbed with the separating claws 210, and when the recording sheet P enters into the fixing device 17, the recording sheet P does not hang down toward the back side thereof, so that fixing wrinkling is not generated.

When $N1 > N2$, the back side of the recording sheet P is rubbed with the separating claws 210. When $N1+1 > N3$, the recording sheet P is waved in the direction perpendicular to the conveyance direction thereof (because the number of back spurred wheels 162 is smaller), thereby, fixing wrinkling is generated.

In order to make the entering direction of the recording sheet P into the fixing device 17 more constant, more than 2 rows of back spurred wheels 162 which are second spurred wheel members, may be provided in parallel to the length direction of the fixing device 17.

Further, it is preferable that the number N1 of separating claws 210 is $3 \leqq N1 \leqq 5$ (the number N1 is 3–5), and the number N2 of front spurred wheels 172 and the number N3 of back spurred wheels 162 are respectively $N2=N1$ (the number N2 is 3–5) and $N3=N1+1$ (the number N3 is 4–6).

When respective numbers N1, N2 and N3 are too small, there is a case in which each type of recording sheet P having different width can not be stably conveyed, and when these are too large, probability becomes high in which the back side of the recording sheet P which is the transfer material, is rubbed with separating claws 210, or the recording sheet P is caught by front spurred wheels 172 which are the first spurred wheel members, or back spurred wheels 162 which are the second spurred wheel members.

Figure 25:
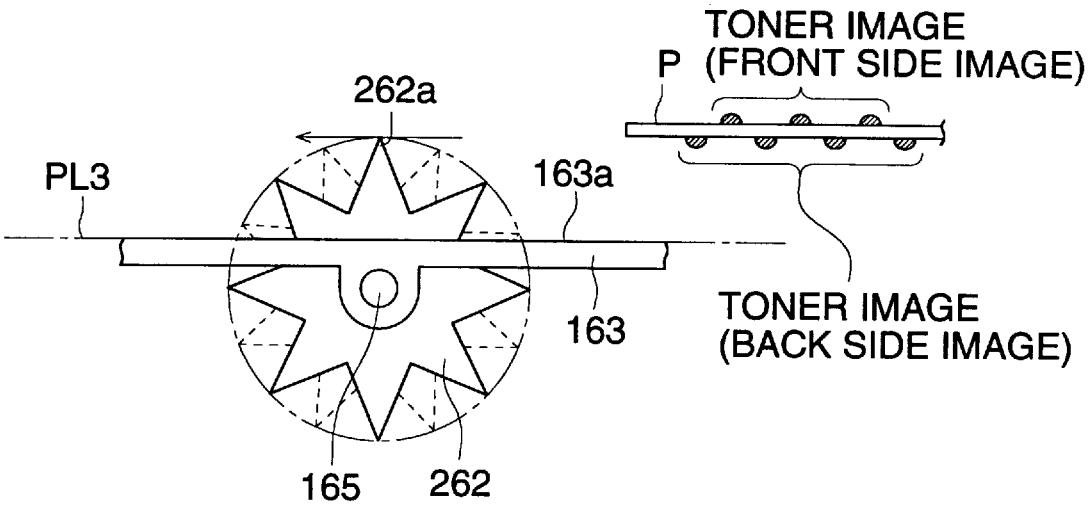
FIG. 25 is a view showing a preferable arrangement of the conveyance guiding member and the second spurred wheel member.

Referring to FIG. 20 and FIG. 25, the eighth structure according to the present example, will be described below. FIG. 25 is a view showing a preferable arrangement of the conveyance guiding member and the second spurred wheel member.

The recording sheet P on both sides of which color toner images are formed, is separated from the toner image receiving body 14*a* by the curvature of the curvature portion KT of the toner image receiving body 14*a,* the discharging operation of the paper separation AC discharger 14*h* as the transfer material separating means, provided at need at the end portion of the toner image receiving body 14*a,* and the separating claw 210 provided with a predetermined interval to the toner image receiving body 14*a,* conveyed to the fixing device 17 as the fixing means, through the front spurred wheel 172 and the back spurred wheel 162, and the toner image on the recording sheet P is fixed by heat and pressure which are applied thereon at the nip portion T between the fixing roller 17*a* and the pressure-contact roller 17*b*.

As shown in FIG. 20, a conveyance guiding member 163 which can guides the back side of the recording sheet P and is extended in the conveyance direction of the recording sheet P, is provided between adjoining back spurred wheels 162. Thereby, even when the leading edge portion of the recording sheet P slightly hangs down toward the back side thereof and is conveyed to the back spurred wheel 162, the hung-down portion of the recording sheet P is lifted up toward the front side of the recording sheet P by the conveyance guiding member 163, so that the leading edge portion of the recording sheet P is firmly supported by the back spurred wheel 162, and the recording sheet P is stably conveyed to the fixing device 17.

In the case where the conveyance guiding member 163 is not provided, when the leading edge portion of the recording sheet P slightly hangs down, it is caught by protrusions 162*a* of the back spurred wheel 162, thereby, jamming occurs, or even when it passes over the back spurred wheel 162 without any trouble, wrinkling occurs when it enters into the fixing device 17.

FIG. 25 is an example in which an octagon-shaped back spurred wheel 262 is used as the second spurred wheel member instead of the hexagon-shaped back spurred wheel 162, and a plane PL3 including the guiding surface 163*a* of the conveyance guiding member 163 is provided on the front side (upper side) of the recording sheet P which is higher than the rotation center of the back spurred wheel 262. Thereby, even when the leading edge of the recording sheet P which is separated from the toner image receiving body 14*a* by the separating claw 210 and conveyed to the back spurred wheel 262 through the front spurred wheel 172, is brought into contact with the guiding surface 163*a,* it is picked up by the guiding surface 163*a,* conveyed to the back spurred wheel 262, and the back spurred wheel 262 is rotated under the condition that protrusions 262*a* of the back spurred wheel 262 are in contact with or stick to the recording sheet P, thereby, the recording sheet P is conveyed to the fixing device 17 without the toner image being rubbed. Further, it is preferable to provide a back spurred wheel 262 which is polygonal, for example, more than octagonal, such that there are at least 3 protrusions 262*a* on the front side of the recording sheet P higher than the plane PL3.

Figure 26:
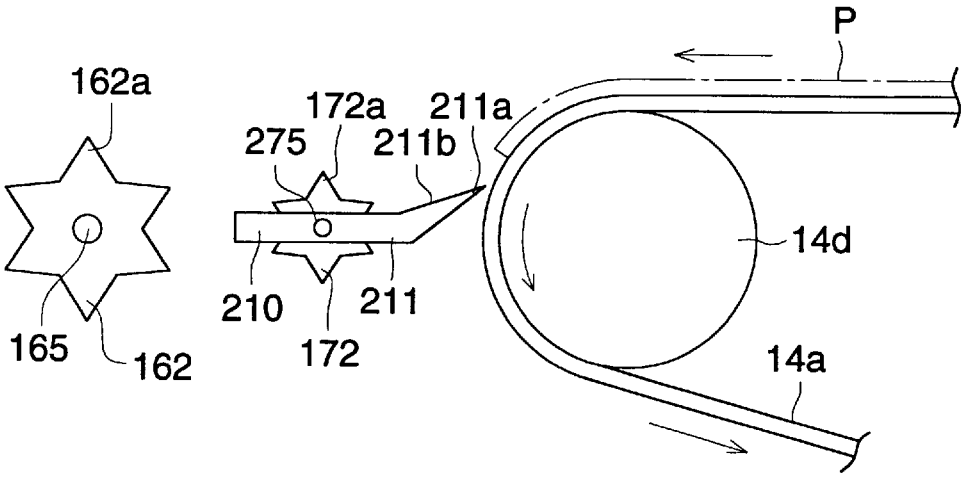
FIG. 26 is a view showing a unit in which the claw member and the first spurred wheel member supporting member are integrated with each other.
Figure 27:
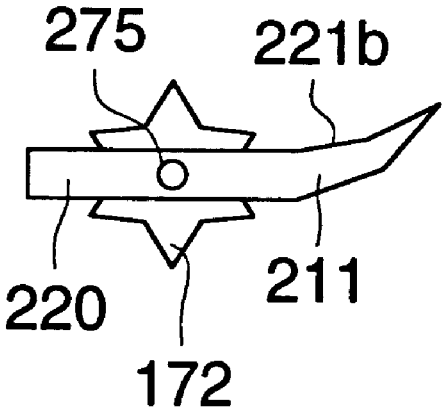
FIG. 27 is a view showing the first example of the claw member with which the first spurred wheel member supporting member is integrated.
Figure 28:
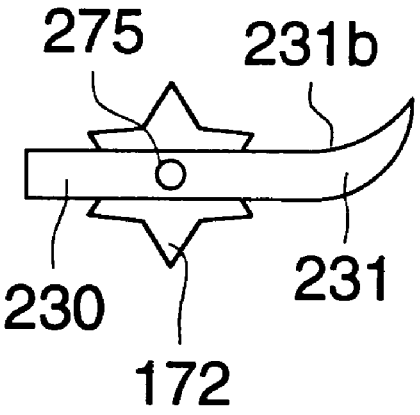
FIG. 28 is a view showing the second example of the claw member with which the first spurred wheel member supporting member is integrated.

Referring to FIGS. 26 to 28, the ninth structure according to the present example will be described below. FIG. 26 is a view showing a unit into which the claw member and the first spurred wheel member supporting member are integrated. FIG. 27 is a view showing a first example of the claw member integrated with the first spurred wheel member supporting member, and FIG. 28 is a view showing a second example of the claw member integrated with the first spurred wheel member supporting member.

The recording sheet P on both sides of which color toner images are formed, is separated from the toner image receiving body 14*a* by the curvature of the curvature portion KT of the toner image receiving body 14*a,* the discharging operation of the paper separation AC discharger 14*h* as the transfer material separating means, provided at need at the end portion of the toner image receiving body 14*a,* and the separating claw 210 provided with a predetermined interval to the toner image receiving body 14*a,* conveyed to the fixing device 17 as the fixing means, through the front spurred wheel 172 and the back spurred wheel 162, and the toner image on the recording sheet P is fixed by heat and pressure which are applied thereon at the nip portion T between the fixing roller 17*a* and the pressure-contact roller 17*b*.

As shown in FIG. 26, it is better that the front spurred wheel 172 which is the first spurred wheel member is located near the separating claw 210 which is the claw member, and in order to have easy positional arrangement for these members, an integral supporting shaft 275, which is the first spurred wheel member supporting member for rotatbly supporting the separating claw 210 and the front spurred wheel 172, is integrated with these members. Further, an upper surface portion 211*b* of the separating claw 210 with which the back side of the recording sheet P is brought into contact, is formed into a concave shape which is curved toward the back side thereof. When the integral supporting shaft 275 for supporting the front spurred wheel 172 is integrally provided with the separating claw 210, positional arrangement of the separating claw 210 with the front spurred wheel 172 becomes easy. After the recording sheet P has been separated from the toner image receiving body 14*a* by the tip portion 211*a* of the claw portion 211 of the separating claw 210, the recording sheet P is immediately separated from the separating claw 210 and guided by the front spurred wheel 172 integrated with the separating claw 210, and relayed to and conveyed by the back spurred wheel 162, thereby, the recording sheet P after separation is finely conveyed to the fixing device 17. Further, by forming the upper surface portion 211*b* of the separating claw 210 into the concave shape curved toward the back side thereof, when the leading edge portion of the recording sheet P in contact with the separating claw 210 is picked up by the front spurred wheel 172, it is prevented that the back side of the recording sheet P is brought into contact with the separating claw 210. As the separating claw 210 integrated with the integral supporting shaft 275 of the front spurred wheel 172, instead of that, a separating claw 220 having a claw portion 221, provided with an upper surface portion 221*b* with the concave shape curved like a V-shape toward the back side thereof, as shown in FIG. 27, or a separating claw 230 having a claw portion 231, provided with an upper surface portion 231*b* formed of a concave-like curved surface toward the back side thereof, as shown in FIG. 28, is used.

According to the present invention, the second image bearing means and the toner image on the second image bearing means are not influenced by heat from the fixing means, the transfer material is finely separated from the second image bearing means, and stably conveyed to the fixing means without the back side toner image being disturbed (rubbed).

Figure 29:
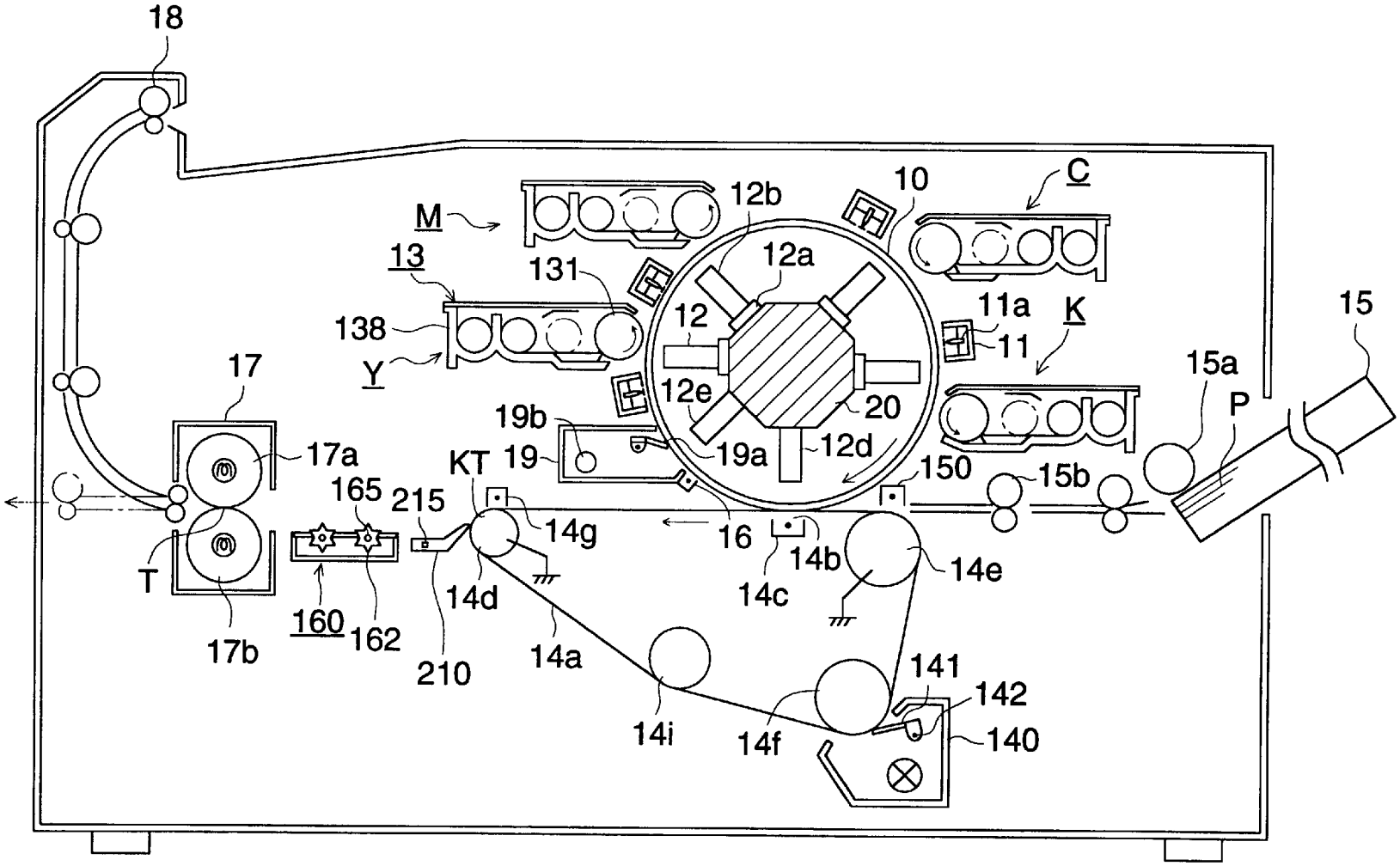
FIG. 29 is a sectional structural view of a color image forming apparatus showing still another example of the image forming apparatus according to the present invention.

Next, another example according to the present invention will be described. Referring to FIG. 29, an image forming process and each mechanism of an example of an image forming apparatus of the present invention will be described below. FIG. 29 is a structural sectional view of a color image forming apparatus showing an example of the image forming apparatus according to the present invention, and a structure and operations different from those in FIG. 1 will be described as follows.

At an end portion of the toner image receiving body 14*a* on the fixing device 17 side, the curvature portion KT is formed by the curvature of the driving roller 14*d*. The driving roller 14*d* which is a roller member, is rotated by the drive of the driving motor, not shown, and the toner image receiving body 14*a* is rotated. By the rotation of the toner image receiving body 14*a*, the driven roller 14*e*, guiding roller 14*f* and tension roller 14*i* are rotated. Looseness of the belt of the rotating toner image receiving body 14*a* is tensioned by the tension roller 14*i*. The recording sheet P which is the transfer material conveyed by the toner image receiving body 14*a*, is separated therefrom by curvature separation at the curvature portion KT at the end portion, on the fixing device 17 side, of the toner image receiving body 14*a* trained around the driving roller 14*d*.

The conveyance section 160 has the separating claw 210 which is the claw member, and the spurred wheel 162 which is the spurred wheel member, and is provided between the curvature portion KT of the toner image receiving body 14*a* and the fixing device 17. By providing the conveyance section 160 between the toner image receiving body 14*a* and the fixing device 17, the following problems can be avoided: the toner image receiving body 14*a* is deformed by heat of the fixing device 17; the toner image of the back side image on the toner image receiving body 14*a* is slightly fused, so that the toner image is hardly transferred; or toner fixedly adheres onto the toner image receiving body 14*a*.

The separating claw 210 which is the claw member is provided in close proximity to the curvature portion KT of the toner image receiving body 14*a*, and is fixed on a supporting shaft 215 provided on the upstream side of the conveyance section 160 in the conveyance direction of the recording sheet P. When the recording sheet P is separated from the toner image receiving body 14*a*, the separating claw 210 comes into contact with the leading edge portion of the recording sheet P which is bending along the curvature portion KT of the toner image receiving body 14*a* and is going to be conveyed, and helps to separate the recording sheet P from the toner image receiving body 14*a*.

The spurred wheel 162 which is the spurred wheel member, is rotatably provided around the rotation supporting shaft 165 on the upper surface of the conveyance section 160, picks up the leading edge portion of the recording sheet P separated from the toner image receiving body 14*a*, guides the back side of the recording sheet P by the plurality of protrusions provided on the circumferential surface thereof, and conveys the recording sheet P to the fixing device 17 while preventing the disturbance of the back side toner image.

In the image forming apparatus of the present invention, the curvature portion KT to separate the recording sheet P from the toner image receiving body 14*a*, is provided at the end portion, on the fixing device 17 side, of the toner image receiving body 14*a* which is the second image bearing means, and a radius of curvature of the curvature portion KT is made not more than 15 mm, and preferably, not more than 10 mm. That is, the end portion, on the fixing device 17 side, of the toner image receiving body 14*a* trained around the driving roller 14*d* is used as the curvature portion KT, and a radius of curvature of the driving roller 14*d* constituting the curvature portion KT is made not more than 15 mm, and preferably, not more than 10 mm. When the radius of curvature is not more than 15 mm, it is not necessary to provide the paper separation AC discharger or a similar device, and separation of the recording sheet P from the toner image receiving body 14*a* is stably carried out by the curvature of the end portion of the toner image receiving body 14*a* and movement of the recording sheet P to the conveyance section 160 is also stably carried out. Specifically, when the radius of curvature is not more than 10 mm, separation of the recording sheet P from the toner image receiving body 14*a* is stably carried out by only the curvature. It is not necessary to provide a discharging mechanism such as the paper separation AC discharger 14*h* or a similar device, thereby, problems such as granular appearance of the front side image due to AC discharging, and transfer failure of the back side image due to interference with electrical discharge of the secondary transferring device 14*g*, can be prevented.

Figure 30:
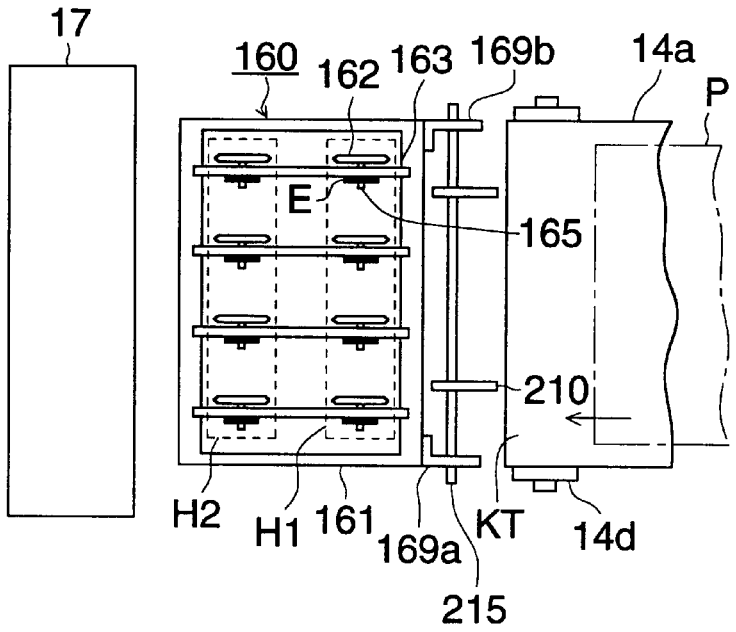
FIG. 30 is a view showing a structure of a conveyance section having the claw members and the spurred wheel members.
Figure 31:
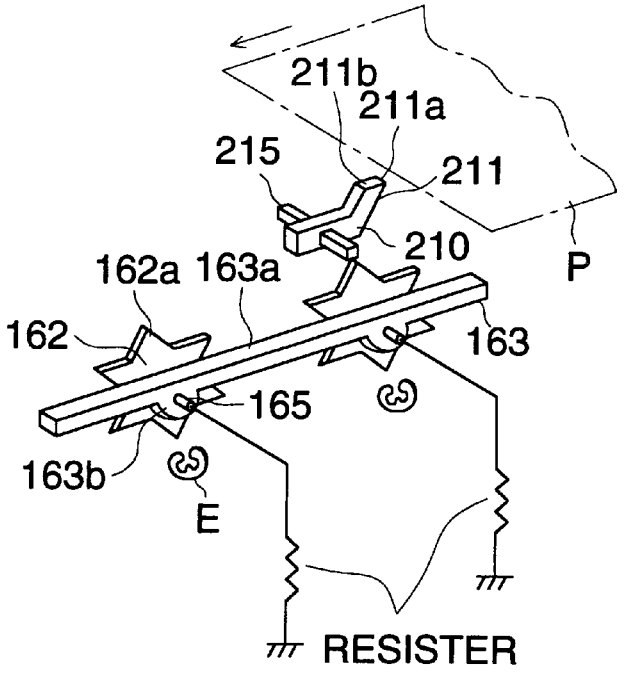
FIG. 31 is a perspective view of a main portion of FIG. 30.
Figure 32:
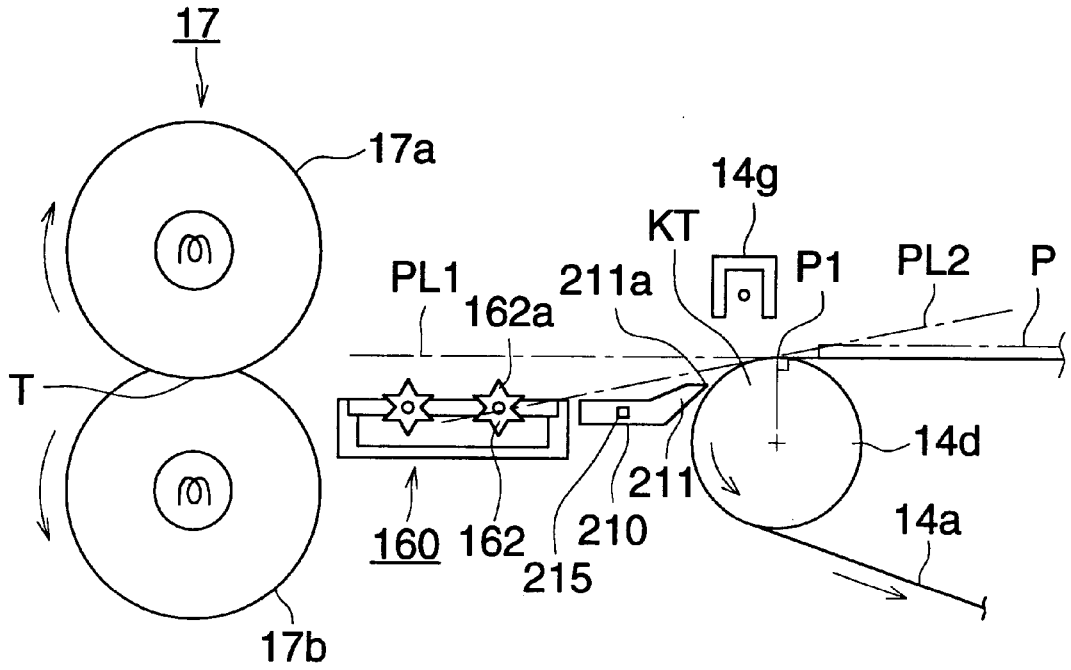
FIG. 32 is a view showing the positional relationship of the second image bearing means, claw members and spurred wheel members.

Referring to FIGS. 30 to 32, the conveyance section having the claw member and the spurred wheel member according to the present invention, will be described below. FIG. 30 is a view showing the structure of the conveyance section having the claw member and the spurred wheel member. FIG. 31 is a perspective view of a main portion of FIG. 30. FIG. 32 is a view showing a positional relationship among the second image bearing means, claw member and spurred wheel members.

As described above, The conveyance section 160 has the separating claw 210 which is the claw member, and the spurred wheel 162 which is the spurred wheel member, and is provided between the curvature portion KT of the toner image receiving body 14*a* and the fixing device 17. By providing the conveyance section 160 between the toner image receiving body 14*a* and the fixing device 17, the following problems can be avoided: the toner image receiving body 14*a* is deformed by heat of the fixing device 17; the toner image of the back side image on the toner image receiving body 14*a* is slightly fused, so that the toner image is hardly transferred; or toner fixedly adheres onto the toner image receiving body 14*a*.

The separating claw 210 is fixed at a predetermined position on, for example, a rectangular rod-like supporting shaft 215 by, for example, adhesive agent, and a plurality of separating claws 210 are arranged in parallel in the direction perpendicular to the conveyance direction of the recording sheet P, that is, in the lengthwise direction of the fixing device 17. The supporting shaft 215 is fixed in holders 169*a* and 169*b* provided on both side ends of the conveyance section 160 on the toner image receiving body 14*a* side.

For the separating claw 210, an insulating resin molding member formed of, for example, Teflon, polyimide, or polycarbonate resin, etc., which has volume resistivity of $10^{10}$–$10^{14}\Omega\cdot$cm, is used. The claw portion 211 which comes into contact with the reading edge portion of the recording sheet P and separate the recording sheet P from the toner image receiving body 14*a*, is provided on the separating claw 210, and the tip portion 211*a* of the claw portion 211 is located with a predetermined distance of, for example, 0.1–2.0 mm, to the curvature portion KT of the toner image receiving body 14*a*. In image formation of the present example, curvature separation is mainly used, therefore, no trouble occurs even when the tip portion 211*a* is located with some distance, however, when the distance is larger than 2.0 mm, that is, too large, sometimes the recording sheet P is not held by the separating claw 210, so that the separation failure occurs. Further, when the distance is not more than 0.1 mm and too small, the toner image on the toner image receiving body 14*a* is rubbed by the tip portion 211*a* of the separating claw 210, or the separating claw 210 is easily stained by toner.

When the recording sheet P is separated at the curvature portion KT of the toner image receiving body 14*a,* the separating claw 210 helps the separation in such a manner that the tip portion 211*a* of the separating claw 210 comes into contact with the leading edge portion of the recording sheet P. Thereby, the recording sheet P is finely separated from the toner image receiving body 14*a,* and even when the environmental condition changes or thin paper is used, the separation failure does not occur.

The rotation supporting shaft 165 integrally provided with the spurred wheel 162 is inserted into a hole of a semi-circular stopping portion 163*b* provided on the opposite side of the guiding surface 163*a* of the conveyance guiding member 163, a tip of the rotation supporting shaft 165 is engaged with E-ring E, and the spurred wheel 162 is rotatably attached to the conveyance guiding member 163. A plurality of the conveyance guiding members on which the spurred wheel 162 is attached are assembled in the conveyance section casing 161, and a plurality of spurred wheels 162 are provided as spurred wheel groups H1, H2 in the direction perpendicular to the conveyance direction of the recording sheet P. At least more than 1 spurred wheel groups are provided as the spurred wheel group.

As the spurred wheel 162, a 0.05–0.5 mm thick, 5–30 mm outer diameter spurred wheel into which a conductive metallic plate such as stainless plate or copper plate is etching processed, or a 0.5–2.0 mm thick, 5–30 mm outer diameter spurred wheel, which has volume resistivity of $10^{10}10^{14}\Omega\cdot$cm, made of semi-conductive resin member such as, for example, Teflon, polyimide, or polycarbonate resin, etc., is used, and the spurred wheel is formed of a polygonal, for example, hexagonal plate member in which sharp protrusions 162*a* are provided at a tip portion thereof.

When the spurred wheel 162 is made of metallic plate, it is preferably electrically grounded through a high resistance body of $10^5$–$10^9\Omega$. When the spurred wheel 162 made of metallic plate, is electrically grounded through a high resistance body, electric charge accumulation on the spurred wheel 162 due to that toner or the transfer material has electric charges, or toner adhesion onto the spurred wheel 162 due to a mirror image force, is prevented, thereby, toner image disturbance or staining of the transfer material can be prevented. When the spurred wheel 162 is made of semi-conductive resin member, it is preferable that the spurred wheel 162 is made in an electrically floating condition or it is electrically grounded through a high resistance body. When the spurred wheel 162 made of semi-conductive resin member is made in an electrically floating condition or is electrically grounded, electric charge accumulation on the spurred wheel 162 or toner adhesion onto the spurred wheel 162 due to a mirror image force can also be prevented in the same manner as in the case where the spurred wheel 162 made of metallic plate is electrically grounded through a high resistance body, thereby, the toner image disturbance or staining of the transfer material can be prevented.

The leading edge portion of the recording sheet P separated by the separating claw 210 is picked up by the spurred wheel 162, and the recording sheet P is sent onto the spurred wheel 162. The spurred wheel 162 is rotated under the condition that the protrusion 162*a* of the spurred wheel 162 is in contact with or sticks the back side of the recording sheet P, the toner image is not rubbed, and the recording sheet P is conveyed to the fixing device 17. Thereby, the recording sheet P having unfixed toner images on both sides thereof, (also on the back side thereof), is stably conveyed while toner image disturbance is being prevented, and fine both side images can be obtained.

As described above, the conveyance section 160 having the separating claw 210 and the spurred wheel 162 is provided between the curvature section KT of the toner image receiving body 14*a* and the fixing device 17. At least the rotation center of the spurred wheel 162 is located on the back surface side (lower side) of the recording sheet P lower then the extended surface PL1 of the conveyance surface of the recording sheet P conveyed on the toner image receiving body 14*a,* as shown in FIG. 32. The separating claw 210 is provided on the back surface side (lower side) of the recording sheet P lower then the surface PL2 including a position P1 at which the curvature portion KT of the toner image receiving body 14*a* begins to have the curvature, and the rotation center of the spurred wheel 162. Thereby, the recording sheet P whose leading edge portion is brought into contact with the separating claw 210 and which is separated from the toner image receiving body 14*a,* is picked up by the spurred wheel 162, and is stably conveyed to the fixing device 17 without the mid-portion of the back side of the recording sheet P being rubbed, (without the back side toner image being disturbed).

Figure 33:
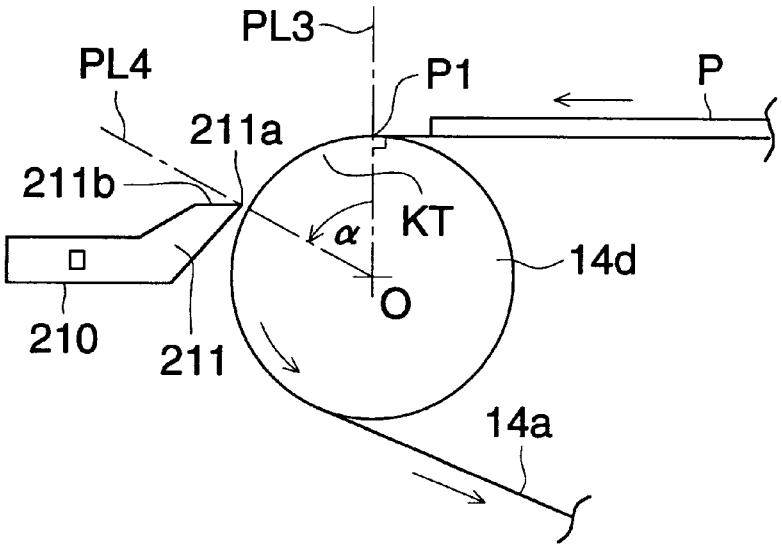
FIG. 33 is a view showing an appropriate position of the tip portion of the claw member.
Figure 34:
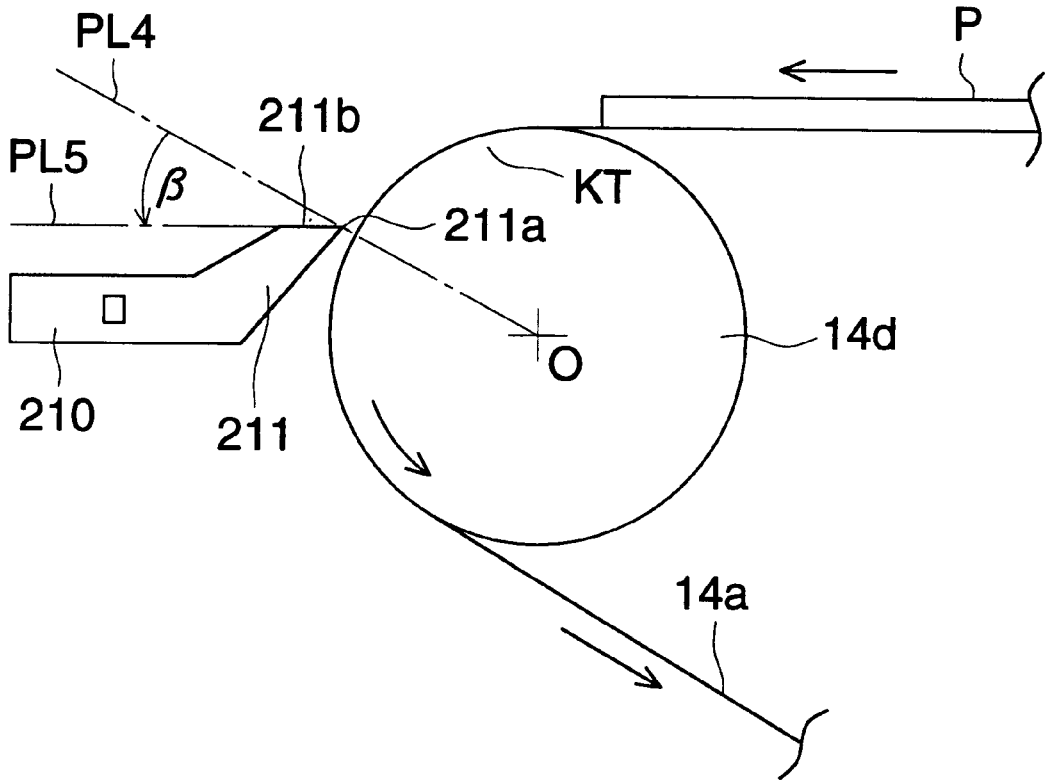
FIG. 34 is a view showing an appropriate angle of a separating surface of the claw member.
Figure 35:
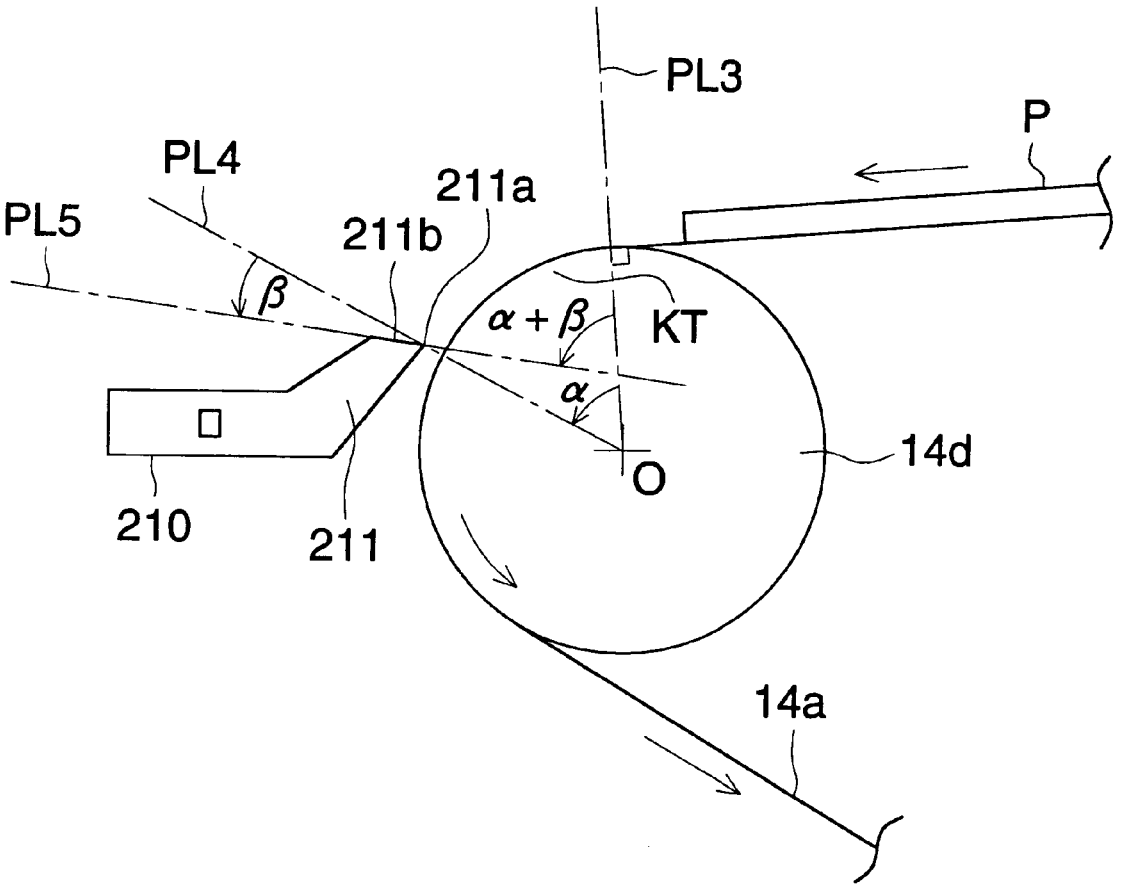
FIG. 35 is a view showing more preferable arrangement of the claw member.

Further, in order to finely conduct the curvature separation, it is preferable that a position of the claw member which will be described in FIGS. 33 to 35, is limited by the following values. FIG. 33 is a view showing an appropriate position of the tip portion of the claw member. FIG. 34 is a view showing an appropriate angle of the separation surface of the claw member. FIG. 35 is a view showing more preferable arrangement of the claw member.

As shown in FIG. 33, as an appropriate range of a position of the tip portion 211*a* of the claw portion 211 of the separating claw 210 with respect to the curvature portion KT of the toner image receiving body 14*a,* when an angle at which a surface PL4 (a surface including a position at which the tip portion 211*a* of the separating claw 210 is in close proximity to the curvature portion KT, and the center of curvature) connecting a position at which the tip portion 211*a* of the separating claw 210 is in close proximity to the curvature portion KT, to the center of curvature O, faces the back surface side of the recording sheet P, with respect to the surface PL3 (a surface including a position at which the curvature section KT begins to have the curvature, and the center of curvature) connecting a position at which the curvature section KT of the toner image receiving body 14*a* begins to have the curvature, to the center of curvature O, is $\alpha(°)$, $45 \leqq \alpha < 90$ is preferable. When $\alpha < 45$, the recording sheet P is caught by the tip portion 211*a* of the claw or the separation surface 211*b* before separation (the mid-portion of the back surface side of the recording sheet P is rubbed with the separating claw 210), therefore, there is a possibility that the back toner image is disturbed. Further, when $90 \leqq \alpha$, after the recording sheet P goes around the curvature portion KT (under the condition that the recording sheet P is deeply wound around the toner image receiving body 14*a*), it is separated by the tip portion 211*a* of the separating claw 210, therefore, there is a possibility that the advancing direction of the leading edge of the separated recording sheet P becomes unstable and is caught by the spurred wheel 162, or jamming occurs at the entering portion of the fixing device 17, the mid-portion of the back surface side of the recording sheet P is rubbed with the separating claw 210 and thereby the back side toner image is disturbed, or the recording sheet P is bent in the middle.

Further, as shown in FIG. 34, as an appropriate range of an angle of the separation surface 211*b* of the tip of the claw 211 of the separating claw 210 with respect to the curvature portion KT of the toner image receiving body 14*a,* when an angle at which a surface PL5, formed by the separation surface 211*b* of the separating claw 210 on the recording sheet P side, with respect to the surface PL4 connecting a position at which the tip portion 211*a* of the separating claw 210 is in close proximity to the curvature portion KT, to the center of curvature O, faces the back surface side of the recording sheet P, is β(°), $0<\beta\leqq 60$ is preferable. When $\beta\leqq 0$ at which the separation surface 211*b* of the tip of the separating claw 210 makes an acute angle with a normal line (a vertical surface) of the curvature portion KT, a danger that the leading edge of the recording sheet P is caught by the tip portion 211*a* of the claw portion 211 or the separation surface 211*b,* is large. Further, when $60<\beta$ at which the separation surface 211*b* is almost in parallel to the normal line (a vertical surface) of the curvature portion KT, the leading edge of the recording sheet P is hardly held on the tip portion 211*a* of the claw portion 211 or on the separation surface 211*b,* and therefore, the reliability of claw separation becomes low. Further, when the leading edge of the recording sheet P is held on the tip portion 211*a* of the claw portion 211 or on the separation surface 211*b,* and the claw separation is carried out, there is a danger that the mid-portion of the back surface side of the recording sheet P is rubbed with the separating claw 210 and the back side toner image is disturbed.

Further, as shown in FIG. 35, it is preferable that a total of the angle α(°) and the angle β(°) is $60\leqq\alpha+\beta\leqq 120$. When $\alpha+\beta<60$, there is a large danger that the leading edge of the recording sheet P is caught by the tip portion 211*a* of the separating claw 210 or the separation surface 211*b.* When $120<\alpha+\beta$, the leading edge of the recording sheet P is hardly held on the tip portion 211*a* of the separating claw 210 or the separation surface 211*b,* and the reliability of the claw separation becomes low. Further, when the leading edge of the recording sheet P is held on the tip portion 211*a* of the claw portion 211 or on the separation surface 211*b,* and the claw separation is carried out, there is a danger that the mid-portion of the back surface side of the recording sheet P is rubbed with the separating claw 210 and the back side toner image is disturbed.

Due to the above description, separation of the recording sheet P from the toner image receiving body 14*a* at the curvature portion KT becomes better.

In the above example, the separating claw 210 and the spurred wheel 162 are respectively arranged with the following distances: the distance between the tip portion 211*a* of the separating claw 210 and the spurred wheel on the separating claw 210 side is about 5 mm–30 mm; the distance between spurred wheels 162 is about 10 mm–50 mm; and the distance between the spurred wheel 162 on the most downstream side in the conveyance direction of the recording sheet P and the entrance position of the nip portion T of the fixing device 17 into which the recording sheet P enters, is about 20 mm–60 mm.

According to the present invention, the transfer material is finely separated from the second image bearing means, stably conveyed to the fixing means without the back side toner image being disturbed (rubbed), and damage of the second image bearing means due to heat of the fixing means can be avoided.

What is claimed is:

1. An image forming apparatus comprising:

(a) a first image bearing means for bearing a toner image formed by a toner image forming means;

(b) a second image bearing means for bearing the toner image which is transferred from said first image bearing means;

(c) a first transferring means for transferring the toner image borne on said first image bearing means onto said second image bearing means or a front side of a transfer material;

(d) a second transferring means for transferring the toner image borne on said second image bearing means onto a back side of said transfer material;

(e) a fixing means for fixing toner images transferred on both sides of said transfer material which is conveyed on said second image bearing means and separated therefrom;

(f) a separating claw for separating said transfer material from said second image bearing means, wherein said separating claw is provided facing a curvature portion provided at an end portion of said second image bearing means on a side of said fixing means, and provided on a side of said second image bearing means with respect to tangential plane of said curvature portion passing an entrance of a nip portion for nipping the transfer material of said fixing means; and (g) a spurred wheel member having a plurality of protrusions on a circumferential surface thereof, rotatably provided between said claw member and said fixing means, for guiding said back side of the transfer material.

2. The image forming apparatus of claim 1, wherein an angle a1 between a tangential line at a contact position at which said separating claw is in contact with said second image bearing means and an extension surface of a conveyance surface of the transfer material on said second image bearing means, is not less than 20° and not more than 50°.

3. The image forming apparatus of claim 1, wherein an angle a2 between a tangential line at a position at which said separating claw is in close vicinity to said second image bearing means and a separating surface of a tip end of said separating claw facing the back side of the transfer material, is not less than 120° and not more than 150°.

4. The image forming apparatus of claim 1, wherein said separating claw is capable of being switched between a close state to and a released state from said second image bearing means.

5. The image forming apparatus of claim 4, wherein while the back side image borne on said second image bearing means passes through, said separating claw is switched to said released state.

6. The image forming apparatus of claim 4, wherein when said separating claw is switched to said close state, a minimum distance between said second image bearing means and a tip end of said separating claw is less than 0.5 mm, and when said separating claw is switched to said released state, the minimum distance between said second image bearing means and the tip end of said separating claw is not less than 0.5 mm.

7. The image forming apparatus of claim 1, wherein said separating claw and said spurred wheel member located nearest to said roller are integrated into a unit.

8. The image forming apparatus of claim 1, wherein said spurred wheel is either electrically floating to a main body of said apparatus or is charged to the same polarity as that of a toner for use in said apparatus.

9. The image forming apparatus of claim 1, wherein said spurred wheel is formed by an insulating member.

10. The image forming apparatus of claim 1, wherein said spurred wheel is grounded through a high resistance member.

11. The image forming apparatus of claim 1, wherein the transfer material is separated at said curvature portion from said second image bearing means, and a radius of curvature at said curvature portion is not more than 15 mm.

12. The image forming apparatus of claim 11, wherein the radius of curvature of said curvature portion is not more than 10 mm.

13. The image forming apparatus of claim 1, wherein said claw member is positioned on a side of said second image bearing means with respect to a plane including a position at which said second image bearing means stars having the curvature, and a rotation axis of said spurred wheel member.

14. The image forming apparatus of claim 1, wherein the transfer material is separated at said curvature portion from said second image bearing means; and wherein an angle a (°) between a line connecting a position at which said second image bearing means stars having the curvature and a center of the curvature, and a line connecting a position at which said claw member is in close vicinity to said curvature portion and the center of the curvature, satisfies the following expression:

$$45 \leqq a \leqq 90,$$

and wherein an angle b (°) between said line connecting the position at which said claw member is in close vicinity to said curvature portion and the center of the curvature, and a separation surface of a tip end of said claw member facing the back side of the transfer material, satisfies the following expression:

$$0 < b \leqq 60.$$

15. The image forming apparatus of claim 14, wherein a sum of the angles a (°) and b (°) satisfies the following expression:

$$60 \leqq a+b \leqq 120.$$

16. The image forming apparatus of claim 14, wherein said second image bearing means is formed by a belt.

17. An image forming apparatus comprising:

(a) a first image bearing means for bearing a toner image formed by a toner image forming means;

(b) a second image bearing means for bearing the toner image which is transferred from said first image bearing means, and for conveying a transfer material;

(c) a first transferring means for transferring the toner image borne on said first image bearing means onto said second image bearing means or a front side of a transfer material;

(d) a second transferring means for transferring the toner image borne on said second image bearing means onto a back side of said transfer material;

(e) a fixing means for fixing toner images transferred on said transfer material which is conveyed on said second image bearing means and separated therefrom;

(f) a curvature portion provided at an end portion of said second image bearing means on a side of said fixing means for separating the transfer material from said second image bearing means;

(g) a claw member provided in the vicinity of said curvature portion, with which a leading edge of the transfer material is brought into contact;

(h) a first spurred wheel member having a plurality of protrusions on a circumferential surface thereof, rotatably provided in the vicinity and downstream of said claw member in a conveyance direction of the transfer material, for guiding a back side of the transfer material; and (i) a second spurred wheel member having a plurality of protrusions on a circumferential surface thereof, rotatably provided between said first spurred wheel member and said fixing means, for guiding said back side of the transfer material, wherein after the leading edge of the transfer material separated from said second image bearing means is brought into contact with said claw member, said first spurred wheel member picks up the leading edge and makes the leading edge advance toward said fixing means while making substantially constant an advancing direction of the leading edge toward said fixing means by said first and second spurred wheel members, and wherein after the leading edge of the transfer material is picked up by said first spurred wheel member, the back side of the transfer material is prevented from being brought into contact with said claw member.

18. An image forming apparatus comprising:

(a) a first image bearing means for bearing a toner image formed by a toner image forming means;

(b) a second image bearing means for bearing the toner image which is transferred from said first image bearing means, and for conveying a transfer material;

(c) a first transferring means for transferring the toner image borne on said first image bearing means onto said second image bearing means or a front side of a transfer material;

(d) a second transferring means for transferring the toner image borne on said second image bearing means onto a back side of said transfer material;

(e) a fixing means for fixing toner images transferred on said transfer material conveyed on said second image bearing means;

(f) a plurality of claw members provided between said second image bearing means and said fixing means and in a direction perpendicular to a conveyance direction of the transfer material, with which a leading edge of the transfer material is brought into contact;

(g) a plurality of first spurred wheel members each having a plurality of protrusions on a circumferential surface thereof, rotatably provided downstream of said plurality of claw members in the conveyance direction of the transfer material, and in the direction perpendicular to the conveyance direction of the transfer material for guiding a back side of the transfer material; and (h) a plurality of second spurred wheel members each having a plurality of protrusions on a circumferential surface thereof, rotatably provided downstream of said plurality of first spurred wheel members in the conveyance direction of the transfer material, and in the direction perpendicular to the conveyance direction of the transfer material, for guiding said back side of the transfer material, wherein the following expression is satisfied:

$$H3 \leqq H2 < H1,$$

where H1 (mm) represents a minimum distance between an extension surface of a conveyance surface of the transfer material conveyed on said second image bearing means and said plurality of claw members, H2 (mm) represents a minimum distance between said extension surface and said plurality of first spurred wheel members, and H3 (mm) represents a minimum distance between said extension surface and said plurality of second spurred wheel members.

19. The image forming apparatus of claim 18, wherein the following expressions are satisfied:

$$R \leqq 15$$

and $$0.3 \text{¥} R \leqq H1 \leqq 0.9 \text{¥} R$$

where R (mm) represents a radius of curvature at an end portion of said second image bearing means on a side of said fixing means, and H1 (mm) represents the minimum distance between said extension surface and said plurality of claw members.

20. An image forming apparatus comprising:

(a) a first image bearing means for bearing a toner image formed by a toner image forming means;

(b) a second image bearing means for bearing the toner image which is transferred from said first image bearing means, and for conveying a transfer material;

(c) a first transferring means for transferring the toner image borne on said first image bearing means onto said second image bearing means or a front side of a transfer material;

(d) a second transferring means for transferring the toner image borne on said second image bearing means onto a back side of said transfer material;

(e) a fixing means for fixing toner images transferred on said transfer material conveyed on said second image bearing means;

(f) a plurality of claw members provided between said second image bearing means and said fixing means and in a direction perpendicular to a conveyance direction of the transfer material, with which a leading edge of the transfer material is brought into contact;

(g) a plurality of first spurred wheel members each having a plurality of protrusions on a circumferential surface thereof, rotatably provided downstream of said plurality of claw members in the conveyance direction of the transfer material, and in the direction perpendicular to the conveyance direction of the transfer material for guiding a back side of the transfer material; and (h) a plurality of second spurred wheel members each having a plurality of protrusions on a circumferential surface thereof, rotatably provided downstream of said plurality of first spurred wheel members in the conveyance direction of the transfer material, and in the direction perpendicular to the conveyance direction of the transfer material, for guiding said back side of the transfer material, wherein the following expression is satisfied:

$$r1 < r2$$

where r1 (mm) represents a radius of curvature of a circumferential surface of each of said plurality of first spurred wheel members, and r2 (mm) represents a radius of curvature of a circumferential surface of each of said plurality of second spurred wheel members.

21. An image forming apparatus comprising:

(a) a first image bearing means for bearing a toner image formed by a toner image forming means;

(b) a second image bearing means for bearing the toner image which is transferred from said first image bearing means, and for conveying a transfer material;

(c) a first transferring means for transferring the toner image borne on said first image bearing means onto said second image bearing means or a front side of a transfer material;

(d) a second transferring means for transferring the toner image borne on said second image bearing means onto a back side of said transfer material;

(e) a fixing means for fixing toner images transferred on said transfer material conveyed on said second image bearing means;

(f) a plurality of claw members provided between said second image bearing means and said fixing means and in a direction perpendicular to a conveyance direction of the transfer material, with which a leading edge of the transfer material is brought into contact;

(g) a plurality of first spurred wheel members each having a plurality of protrusions on a circumferential surface thereof, rotatably provided downstream of said plurality of claw members in the conveyance direction of the transfer material, and in the direction perpendicular to the conveyance direction of the transfer material for guiding a back side of the transfer material; and (h) a plurality of second spurred wheel members each having a plurality of protrusions on a circumferential surface thereof, rotatably provided downstream of said plurality of first spurred wheel members in the conveyance direction of the transfer material, and in the direction perpendicular to the conveyance direction of the transfer material, for guiding said back side of the transfer material, wherein the following expression is satisfied:

$$P1 < P2$$

where P1 (mm) represents a distance between adjacent protrusions of each of said plurality of first spurred wheel members, and P2 (mm) represents a distance between adjacent protrusions of each of said plurality of second spurred wheel members.

22. An image forming apparatus comprising:

(a) a first image bearing means for bearing a toner image formed by a toner image forming means;

(b) a second image bearing means for bearing the toner image which is transferred from said first image bearing means, and for conveying a transfer material;

(c) a first transferring means for transferring the toner image borne on said first image bearing means onto said second image bearing means or a front side of a transfer material;

(d) a second transferring means for transferring the toner image borne on said second image bearing means onto a back side of said transfer material;

(e) a fixing means for fixing toner images transferred on said transfer material conveyed on said second image bearing means;

(f) a plurality of claw members provided between said second image bearing means and said fixing means and in a direction perpendicular to a conveyance direction of the transfer material, with which a leading edge of the transfer material is brought into contact;

(g) a plurality of first spurred wheel members each having a plurality of protrusions on a circumferential surface thereof, rotatably provided downstream of said plurality of claw members in the conveyance direction of the transfer material, and in the direction perpendicular to the conveyance direction of the transfer material for guiding a back side of the transfer material; and (h) a plurality of second spurred wheel members each having a plurality of protrusions on a circumferential surface thereof, rotatably provided downstream of said plurality of first spurred wheel members in the conveyance direction of the transfer material, and in the direction perpendicular to the conveyance direction of the transfer material, for guiding said back side of the transfer material, wherein the following expression is satisfied:

$$d1 < d2$$

where d1 (mm) represents a minimum distance between a transverse section which is perpendicular to the conveyance surface of the transfer material and crosses a center portion of each of said plurality of claw members in the conveyance direction of the transfer material, and a circumferential surface of each of said plurality of first spurred wheel members which is closest to said transverse section, and d2 represents a minimum distance between said transverse section and a circumferential surface of each of said plurality of second spurred wheel members which is closest to said transverse section.

23. The image forming apparatus of claim 22, wherein the following expression is satisfied:

$$0.3 \text{ ¥ } d3 \leqq d2 \leqq 0.7 \text{ ¥ } d3$$

where d3 (mm) represents a distance between a claw of said claw members in which the transverse section intersects, and an adjacent claw closest to the transverse section in which a second spurred wheel member closest to the transverse section is interposed therebetween.

24. An image forming apparatus comprising:

(a) a first image bearing means for bearing a toner image formed by a toner image forming means;

(b) a second image bearing means for bearing the toner image which is transferred from said first image bearing means, and for conveying a transfer material;

(c) a first transferring means for transferring the toner image borne on said first image bearing means onto said second image bearing means or a front side of a transfer material;

(d) a second transferring means for transferring the toner image borne on said second image bearing means onto a back side of said transfer material;

(e) a fixing means for fixing toner images transferred on said transfer material conveyed on said second image bearing means;

(f) a plurality of claw members provided between said second image bearing means and said fixing means and in a direction perpendicular to a conveyance direction of the transfer material, with which a leading edge of the transfer material is brought into contact;

(g) a plurality of first spurred wheel members each having a plurality of protrusions on a circumferential surface thereof, rotatably provided downstream of said plurality of claw members in the conveyance direction of the transfer material, and in the direction perpendicular to the conveyance direction of the transfer material for guiding a back side of the transfer material; and (h) a plurality of second spurred wheel members each having a plurality of protrusions on a circumferential surface thereof, rotatably provided downstream of said plurality of first spurred wheel members in the conveyance direction of the transfer material, and in the direction perpendicular to the conveyance direction of the transfer material, for guiding said back side of the transfer material, wherein the following expression is satisfied:

$$W1 \leqq W2 \leqq W3$$

where W1 represents a distance between two claws of said claw members which are most spaced from each other, W2 represents a distance between two spurred wheel members of said first spurred wheel members which are most spaced from each other, W3 represents a distance between two spurred wheel members of said second spurred wheel members which are most spaced from each other.

25. The image forming apparatus of claim 24, wherein the following expression is satisfied:

$$0.8 \text{ ¥ } W4 \leqq W3 \leqq 0.95 \text{ ¥ } W4$$

where W4 represents a maximum width of the transfer material in the direction perpendicular to the conveyance direction of the transfer material.

26. An image forming apparatus comprising:

(a) a first image bearing means for bearing a toner image formed by a toner image forming means;

(b) a second image bearing means for bearing the toner image which is transferred from said first image bearing means, and for conveying a transfer material;

(c) a first transferring means for transferring the toner image borne on said first image bearing means onto said second image bearing means or a front side of a transfer material;

(d) a second transferring means for transferring the toner image borne on said second image bearing means onto a back side of said transfer material;

(e) a fixing means for fixing toner images transferred on said transfer material conveyed on said second image bearing means;

(f) a plurality of claw members provided between said second image bearing means and said fixing means and in a direction perpendicular to a conveyance direction of the transfer material, with which a leading edge of the transfer material is brought into contact;

(g) a plurality of first spurred wheel members each having a plurality of protrusions on a circumferential surface thereof, rotatably provided downstream of said plurality of claw members in the conveyance direction of the transfer material, and in the direction perpendicular to the conveyance direction of the transfer material for guiding a back side of the transfer material; and (h) a plurality of second spurred wheel members each having a plurality of protrusions on a circumferential surface thereof, rotatably provided downstream of said plurality of first spurred wheel members in the conveyance direction of the transfer material, and in the direction perpendicular to the conveyance direction of the transfer material, for guiding said back side of the transfer material, wherein the following expression is satisfied:

$$N1 \leqq N2$$

and $$N1+1 \leqq N3$$

where N1 represents a number of said claw members in use, N2 represents a number of said first spurred wheel members in use, and N3 represents a number of said second spurred wheel members in use.

27. The image forming apparatus of claim 26, wherein the following expressions are satisfied:

$$3 \leqq N1 < 5$$

$$N2 = N1$$

and $$N3 = N1 + 1.$$

28. An image forming apparatus comprising:

(a) a first image bearing means for bearing a toner image formed by a toner image forming means;

(b) a second image bearing means for bearing the toner image which is transferred from said first image bearing means, and for conveying a transfer material;

(c) a first transferring means for transferring the toner image borne on said first image bearing means onto said second image bearing means or a front side of a transfer material;

(d) a second transferring means for transferring the toner image borne on said second image bearing means onto a back side of said transfer material;

(e) a fixing means for fixing toner images transferred on said transfer material conveyed on said second image bearing means;

(f) a plurality of claw members provided between said second image bearing means and said fixing means and in a direction perpendicular to a conveyance direction of the transfer material, with which a leading edge of the transfer material is brought into contact;

(g) a plurality of first spurred wheel members each having a plurality of protrusions on a circumferential surface thereof, rotatably provided downstream of said plurality of claw members in the conveyance direction of the transfer material, and in the direction perpendicular to the conveyance direction of the transfer material for guiding a back side of the transfer material;

(h) a plurality of second spurred wheel members each having a plurality of protrusions on a circumferential surface thereof, rotatably provided downstream of said plurality of first spurred wheel members in the conveyance direction of the transfer material, and in the direction perpendicular to the conveyance direction of the transfer material, for guiding said back side of the transfer material; and (i) an conveyance guiding member provided between adjacent two second spurred wheel members and extended to the conveyance direction of the transfer material for guiding the back side of the transfer material.

29. The image forming apparatus of claim 28, wherein a plane surface including a guide surface of said conveyance guiding member is positioned on a side of the transfer material with respect to each rotation axis of said second spurred wheel members, and said plane surface is arranged so that at least three protrusions of each of said second spurred wheel members exist on the front side of the transfer material with respect to said plane surface.

30. An image forming apparatus comprising:

(a) a first image bearing means for bearing a toner image formed by a toner image forming means;

(b) a second image bearing means for bearing the toner image which is transferred from said first image bearing means, and for conveying a transfer material;

(c) a first transferring means for transferring the toner image borne on said first image bearing means onto said second image bearing means or a front side of a transfer material;

(d) a second transferring means for transferring the toner image borne on said second image bearing means onto a back side of said transfer material;

(e) a fixing means for fixing toner images transferred on said transfer material conveyed on said second image bearing means;

(f) a plurality of claw members provided between said second image bearing means and said fixing means and in a direction perpendicular to a conveyance direction of the transfer material, with which a leading edge of the transfer material is brought into contact;

(g) a plurality of first spurred wheel members each having a plurality of protrusions on a circumferential surface thereof, rotatably provided downstream of said plurality of claw members in the conveyance direction of the transfer material, and in the direction perpendicular to the conveyance direction of the transfer material for guiding a back side of the transfer material; and (h) a plurality of second spurred wheel members each having a plurality of protrusions on a circumferential surface thereof, rotatably provided downstream of said plurality of first spurred wheel members in the conveyance direction of the transfer material, and in the direction perpendicular to the conveyance direction of the transfer material, for guiding said back side of the transfer material, wherein said claw members and a supporting member for supporting said first spurred wheel members are integrally formed as a unit, and a surface of each of said claw members which is in contact with the transfer material is formed to be concave.

* * * * *